US011992128B2

(12) United States Patent
Alletto, Jr.

(10) Patent No.: US 11,992,128 B2
(45) **Date of Patent: *May 28, 2024**

(54) MATTRESS ASSEMBLY AND METHOD

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 176 days.

This patent is subject to a terminal disclaimer.

(21) Appl. No.: 17/528,632

(22) Filed: Nov. 17, 2021

(65) Prior Publication Data

US 2022/0071405 A1 Mar. 10, 2022

Related U.S. Application Data

(63) Continuation of application No. 15/789,369, filed on Oct. 20, 2017, now Pat. No. 11,191,366.

(60) Provisional application No. 62/460,411, filed on Feb. 17, 2017, provisional application No. 62/413,717, filed on Oct. 27, 2016.

(51) Int. Cl.

| | |
|---|---|
| ***A47C 23/00*** | (2006.01) |
| ***A47C 19/12*** | (2006.01) |
| ***A47C 23/043*** | (2006.01) |
| ***A47C 27/06*** | (2006.01) |
| ***A47C 31/10*** | (2006.01) |

(52) U.S. Cl.

CPC ..... *A47C 23/005* (2013.01); *A47C 19/124* (2013.01); *A47C 23/0433* (2013.01); *A47C 27/064* (2013.01); *A47C 31/105* (2013.01)

(58) Field of Classification Search

CPC . A47C 23/005; A47C 19/124; A47C 23/0433; A47C 27/064; A47C 31/105

USPC ..... 5/722

See application file for complete search history.

(56) References Cited

U.S. PATENT DOCUMENTS 1,671,363 A * 5/1928 Gail ..... A47C 27/064 5/720

1,845,791 A 2/1932 Gray (Continued)

OTHER PUBLICATIONS

European Patent Office, Netherlands; European Patent Application No. 17 794530.0, dated Oct. 16, 2020.

(Continued)

*Primary Examiner* — Justin C Mikowski
*Assistant Examiner* — Luke Hall
(74) *Attorney, Agent, or Firm* — Sorell, Lenna & Schmidt, LLP

(57) ABSTRACT

A mattress assembly includes a chassis having top and bottom walls and first and second sidewalls that each extend from the top wall to the bottom wall. Inner surfaces of the walls and the sidewalls define an interior cavity. The top and bottom walls each include a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. A spring assembly is configured to be positioned within the interior cavity.

16 Claims, 23 Drawing Sheets

(56) References Cited

U.S. PATENT DOCUMENTS 1,915,659 A * 6/1933 Gail ..... A47C 27/05 5/717
1,986,255 A * 1/1935 Durfey ..... A47C 27/062 5/717
2,870,824 A * 1/1959 Le Barre ..... A47C 31/105 5/482
3,083,381 A * 4/1963 Bailey ..... A47C 27/088 219/217
4,449,261 A * 5/1984 Magnusson ..... A47C 21/044 5/722
4,788,727 A * 12/1988 Liu ..... A47C 19/005 5/174
4,955,095 A * 9/1990 Gerrick ..... A47C 31/105 5/691
5,557,813 A * 9/1996 Steed ..... A47C 27/001 5/678
5,740,574 A * 4/1998 Piraino ..... A47C 27/001 5/716
5,819,349 A * 10/1998 Schwartz ..... A47C 27/148 5/740
6,886,197 B1 * 5/2005 Madigan ..... A47G 9/02 5/482
7,845,030 B1 12/2010 Pollard
8,561,235 B2 * 10/2013 Oh ..... A47G 9/0246 5/692
2008/0092289 A1 4/2008 Smith et al.
2008/0098533 A1 * 5/2008 Erdman ..... A47C 31/105 5/722
2008/0201856 A1 * 8/2008 Howard ..... A47C 31/123 5/690
2009/0100606 A1 * 4/2009 An ..... A47C 27/064 5/716
2011/0247144 A1 * 10/2011 Oh ..... A47C 20/041 5/722
2015/0359349 A1 * 12/2015 Eigenmann ..... A47C 7/742 5/655.8
2016/0192786 A1 * 7/2016 Holbrook ..... A47C 27/14 5/691
2016/0353907 A1 * 12/2016 Lava ..... A47C 27/001
2016/0367042 A1 * 12/2016 Fisher ..... A47C 7/18
2018/0116417 A1 5/2018 Alletto, Jr.

OTHER PUBLICATIONS

International Search Report and Written Opinion of the International Searching Authority, European Patent Office, PCT/US2017/092289, dated May 9, 2019.
PCT/US2017/057604 International Search Report, Written Opinion of the International Searching Authority, dated Dec. 15, 2017.
Ministry of Justice, Israel Patent Office, Israeli Patent Application No. 266256, 1st examination report, dated Mar. 28, 2022.
Australian Government—IP Australia, Examination report No. 1 for standard patent application, Application No. 2017351032, dated Sep. 20, 2022.

* cited by examiner

MATTRESS ASSEMBLY AND METHOD

CROSS-REFERENCE TO RELATED APPLICATIONS

This application is a continuation application of U.S. patent application Ser. No. Oct. 20, 2017, filed on Oct. 20, 2017, which is expressly incorporated by reference herein, in its entirety.

TECHNICAL FIELD

The present disclosure generally relates to bedding, and more particularly to mattress assemblies that are modular and configured to be shipped in one or a plurality of boxes by ground delivery and that can be easily assembled upon delivery.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

Typically, mattresses are shipped to a destination as freight due to the size of the mattress. That is, most mattresses cannot be shipped by ground delivery because the mattresses each exceed the size permitted for ground delivery. Freight shipping is typically much more expensive than shipping by ground delivery. As such, shipping mattresses as freight increases costs associated with purchasing a mattress. This disclosure describes an improvement over these prior art technologies.

SUMMARY

In one embodiment, in accordance with the principles of the present disclosure, a mattress assembly is provided. The mattress assembly includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. A spring assembly is positioned within the interior cavity.

In one embodiment, in accordance with the principles of the present disclosure, a mattress assembly is provided that includes a chassis comprising top and bottom walls and first and second sidewalls that each extend from the top wall to the bottom wall, inner surfaces of the walls and the sidewalls defining an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The chassis comprises a base layer that extends from the top wall to the bottom wall and from the first sidewall to the second sidewall. A cover is coupled to outer surfaces of the walls and the sidewalls. A tambor is positioned on top of the base layer. A spring assembly is positioned on top of the tambor. The spring assembly comprises a first spring assembly and a second spring assembly that is removeably coupled to the first spring assembly. The first spring assembly has a firmness that is different from a firmness of the second spring assembly. A topper is coupled to the cover such that the topper is positioned on top of the spring assembly, the topper being removeably coupled to the cover by a zipper. The chassis is movable between a first configuration in which the sections each extend transverse to the sidewalls and a second configuration in which the sections each extend parallel to the sidewalls.

In one embodiment, in accordance with the principles of the present disclosure, a kit is provided that includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The chassis comprises a base layer that extends from the top wall to the bottom wall and from the first sidewall to the second sidewall. The kit includes a tambor positioned configured to be positioned on top of the base layer, a cover configured to be coupled to outer surfaces of the walls and the sidewalls and a topper configured to be coupled to the cover.

In one embodiment, in accordance with the principles of the present disclosure, a method of assembling a mattress is provided that includes providing a mattress assembly that includes a chassis comprising top and bottom walls and first and second sidewalls that each extend from the top wall to the bottom wall. Inner surfaces of the walls and the sidewalls define an interior cavity. The top and bottom walls each comprise a first section that is connected to the first sidewall and a second section that is connected to the second sidewall such that the first sections are pivotable relative to the first sidewall and the second sections are pivotable relative to the second sidewall. The first section of the top wall is pivotable relative to the second section of the top wall and the first section of the bottom wall is pivotable relative to the second section of the bottom wall. The mattress assembly includes a spring assembly configured to be positioned within the interior cavity. The method includes moving the chassis from a first configuration in which the sections each extend parallel to the sidewalls and a second configuration in which the sections each extend transverse to the sidewalls. A tambor is positioned within the interior cavity. A spring assembly is positioned within the interior cavity such that the spring assembly is positioned on top of the tambor. A topper is attached to the cover such that the topper is positioned on top of the spring assembly.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
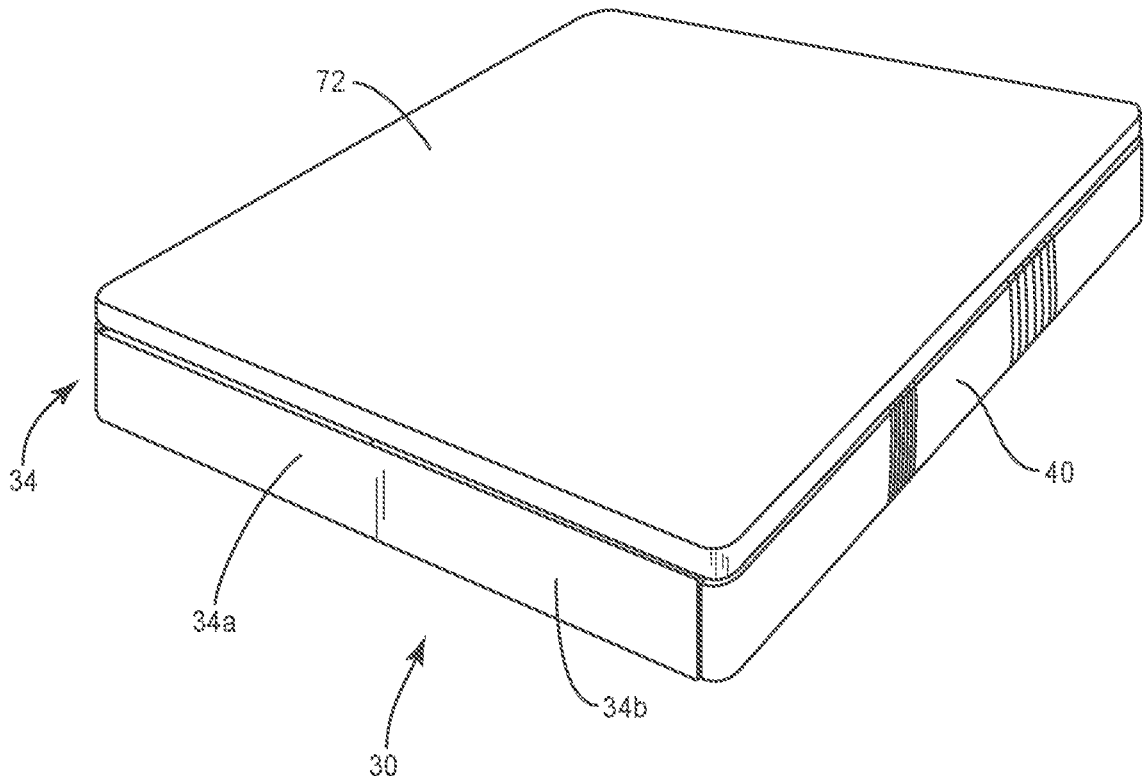
FIG. 1 is a perspective view of a mattress assembly in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

In addition, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a mattress topper in accordance with the principles of the present disclosure. Alternate embodiments are also disclosed. Reference will now be made in detail to the exemplary embodiments of the present disclosure, which are illustrated in the accompanying figures. Turning to FIGS. 1-26, there are illustrated components of an air multiplier pad, such as, for example, a mattress assembly 30.

Mattress assembly 30 is configured to lie on top of a box spring. In some embodiments, mattress assembly 30 is configured to cover all or a portion of a top surface of the box spring. In some embodiments, mattress assembly 30 is configured to be larger than the top surface of the box spring. In some embodiments, mattress assembly 30 has substantially the same size and shape as the top surface of the box spring. In some embodiments, mattress assembly 30 is a standard size mattress, such as, for example, a twin mattress, a full mattress, a queen mattress, a king mattress, or a California king mattress. In some embodiments, mattress assembly 30 is a crib mattress.

Mattress assembly 30 includes a chassis 32 comprising a top wall 34 and a bottom wall 36 positioned opposite top wall 34. Chassis 32 includes a first sidewall 38 and a second sidewall 40 positioned opposite first sidewall 38. Sidewalls 38, 40 each extend from top wall 34 to bottom wall 36. Inner surfaces of top and bottom walls 34, 36 and sidewalls 38, 40 define an interior cavity 42 configured for disposal of a tambor and one or more spring packs, as discussed herein. In some embodiments, chassis is made from a rigid material, such as, for example, PVC to provide strength and rigidity to chassis 32.

Top wall 34 comprises a first section 34*a* that is connected to sidewall 38 and a second section 34*b* that is connected to sidewall 40. Section 34*a* is connected to sidewall 38 by a mechanical bearing, such as, for example a hinge 44 (FIGS. 3 and 3A) to allow section 34*a* to pivot relative to sidewall 38. The hinge 44 that connects section 34*a* to sidewall 38 is configured to move section 34*a* between a first orientation in which section 34*a* extends at an acute angle relative to sidewall 38 and a second orientation in which section 34*a* extends perpendicular relative to sidewall 38. Section 34*b* is connected to sidewall 40 by a hinge 44 to allow section 34*b* to pivot relative to sidewall 40. The hinge 44 that connects section 34*b* to sidewall 40 is configured to move section 34*b* between a first orientation in which section 34*b* extends at an acute angle relative to sidewall 40 and a second orientation in which section 34*b* extends perpendicular relative to sidewall 40. Bottom wall 36 comprises a first section 36*a* that is connected to sidewall 38 and a second section 36*b* that is connected to sidewall 40. Section 36*a* is connected to sidewall 38 by a hinge 44 to allow section 36*b* to pivot relative to sidewall 38. The hinge 44 that connects section 36*a* to sidewall 38 is configured to move section 36*a* between a first orientation in which section 36*a* extends at an acute angle relative to sidewall 38 and a second orientation in which section 36*a* extends perpendicular relative to sidewall 38. Section 36*b* is connected to sidewall 40 by a hinge 44 to allow section 36*b* to pivot relative to sidewall 40. The hinge 44 that connects section 36*b* to sidewall 40 is configured to move section 36*b* between a first orientation in which section 36*b* extends at an acute angle relative to sidewall 40 and a second orientation in which section 36*b* extends perpendicular relative to sidewall 40.

Figure 3:
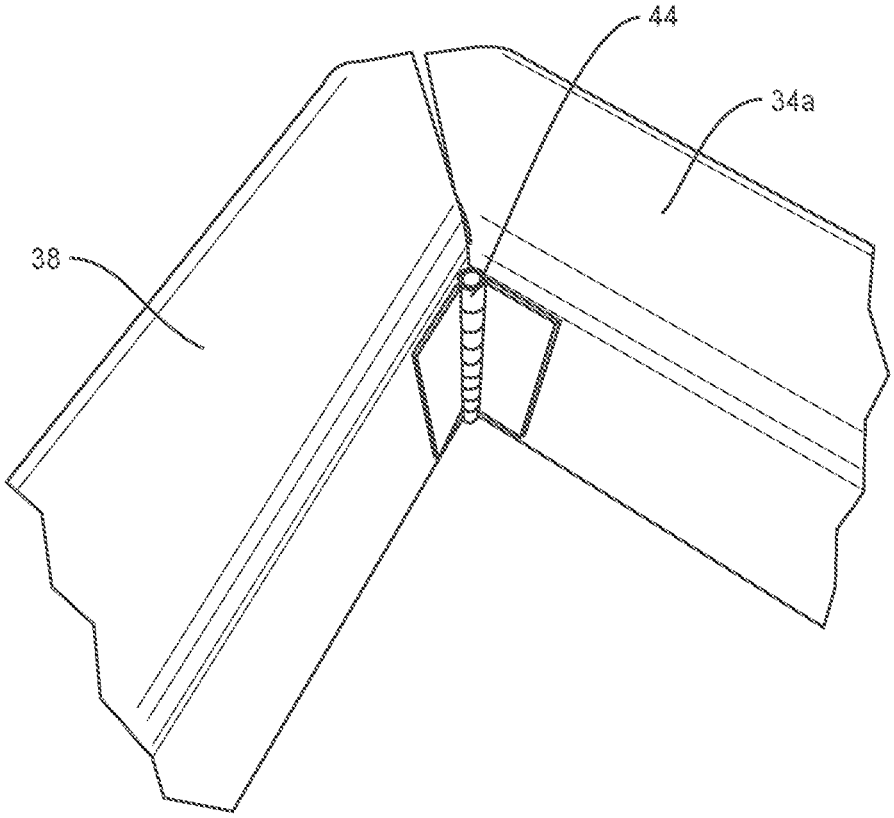
FIG. 3 is a perspective view of components of the mattress assembly shown in FIG. 1.
Figure 7:
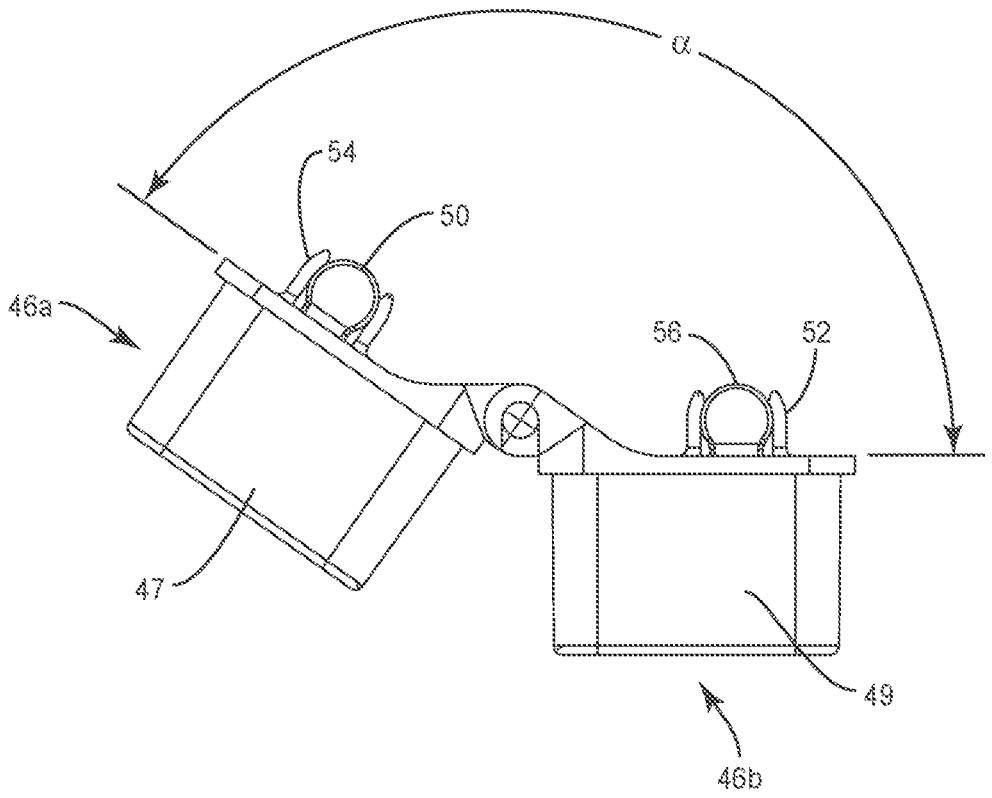
FIG. 7 is an end view of the component shown in FIG. 4.

In some embodiments, hinges 44 are coupled to inner surfaces of walls 34, 36 and sidewalls 38, 40, as shown in FIG. 3, for example. For example, a first portion of the hinge 44 that connects section 34*a* of wall 34 to sidewall 38 is fixed to the inner surface of sidewall 38 and a second portion of the hinge 44 that connects section 34*a* of wall 34 to sidewall 38 is fixed to the inner surface of top wall 34, as shown in FIG. 7. The hinges 44 that connect sections 34*b*, 36*a*, and 36*b* with sidewalls 38, 40 can be similarly positioned, as would be understood by one of ordinary skill in the art. In some embodiments, chassis 32 is monolithic and hinges 44 are living hinges. In such embodiments, interfaces between walls 34, 36 and sidewalls 38, 40 have a reduced thickness to allow walls 34, 36 to pivot relative to sidewalls 38, 40. In some embodiments, at least one of hinges 44 may include a barrel hinge, a pivot hinge, a mortise hinge, a case hinge, a piano hinge, a concealed hinge, a butterfly hinge, a flag hinge, a strap hinge, an H hinge, an HL hinge, a counter flap hinge, a flush hinge, a coach hinge, a rising butt hinge, a double action spring hinge, a tee hinge, a friction hinge, a security hinge, a cranked hinge, a lift-off hinge, or a self-closing hinge. In some embodiments, at least one of hinges 44 may include a hinge that is embedded within at least one of walls 34, 36 and sidewalls 38, 40. In some embodiments, at least one of hinges 44 may include a seatbelt like snap and release. In such embodiments, hinge 44 includes a male buckle end that snaps into a female buckle end.

Figure 3A:
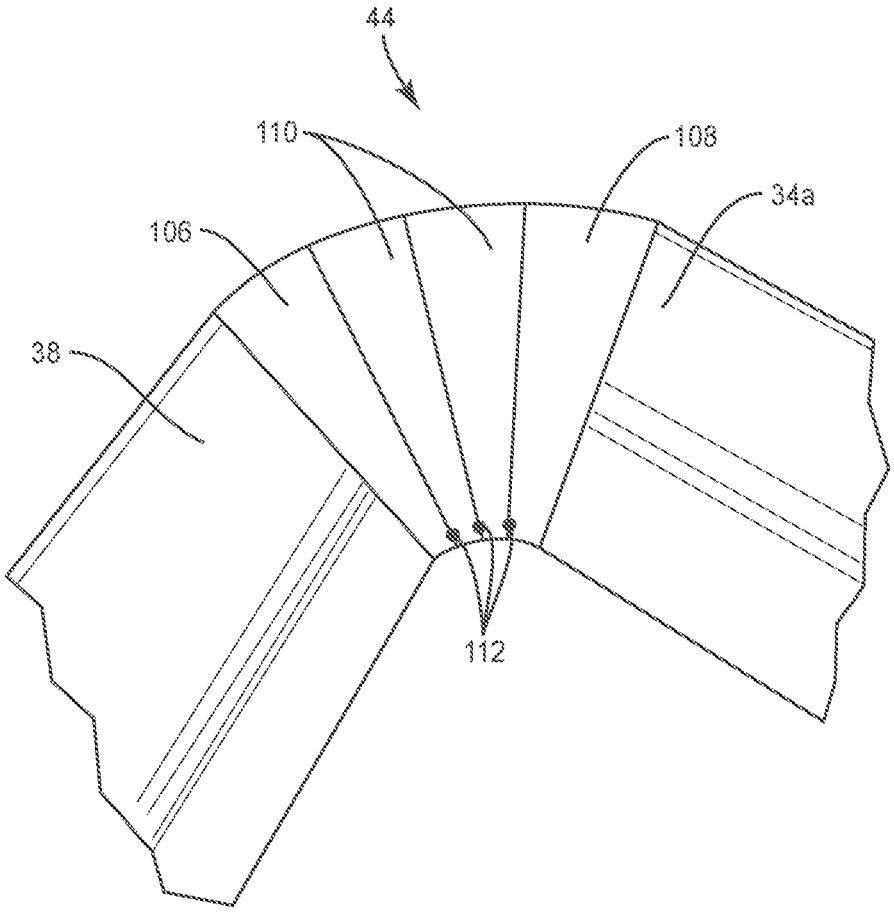
FIG. 3A is a perspective view of components of the mattress assembly shown in FIG. 1.

In some embodiments, as shown in FIG. 3A, one or more of hinges 44 may include a section 106 and a section 108. In some embodiments, section 106 is coupled to sidewall 38 and section 108 is coupled to section 34*a* of wall 34. In some embodiments, section 106 is coupled to sidewall 40 and section 108 is coupled to section 34*b* of wall 34. In some embodiments, section 106 is coupled to sidewall 38 and section 108 is coupled to section 36*a* of wall 36. In some embodiments, section 106 is coupled to sidewall 40 and section 108 is coupled to section 36*b* of wall 36. In some embodiments, section 106 is directly coupled to section 108. In some embodiments, hinge 44 includes one or a plurality of sections 110 that are positioned between section 106 and section 108. A pin 112 extends through sections 106 and 110 to allow section 106 to pivot relative to section 110. Likewise, a pin 112 extends through sections 108 and 110 to allow section 108 to pivot relative to section 110. In embodiments that include a plurality of sections 110, a pin 112 also extends through adjacent sections 110 to allow the adjacent sections 110 to pivot relative to one another. In some embodiments, as section 106 pivots relative to section 110, a portion of section 106 rotates within a cavity in section 110 and/or a portion of section 110 rotates within a cavity in section 106. In some embodiments, as section 108 pivots relative to section 110, a portion of section 108 rotates within a cavity in section 110 and/or a portion of section 110 rotates within a cavity in section 108. In some embodiments, as one of sections 110 pivots relative to another one of sections 110, a portion of one of sections 110 rotates within a cavity in another one of sections 110.

Section 34*a* of wall 34 is connected to section 34*b* of wall 34 by a mechanical bearing, such as, for example, a hinge 46 such that section 34*a* is pivotable relative to section 34*b*. Section 36*a* of wall 36 is connected to section 36*b* of wall 36 by a hinge 46 such that section 36*a* is pivotable relative to section 36*b*. In some embodiments, hinges 46 are identical or similar to hinges 44. In some embodiments, hinges 46 are different from hinges 44. In some embodiments, at least one of hinges 46 may include a barrel hinge, a pivot hinge, a mortise hinge, a case hinge, a piano hinge, a concealed hinge, a butterfly hinge, a flag hinge, a strap hinge, an H hinge, an HL hinge, a counter flap hinge, a flush hinge, a coach hinge, a rising butt hinge, a double action spring hinge, a tee hinge, a friction hinge, a security hinge, a cranked hinge, a lift-off hinge, or a self-closing hinge.

Figure 9:
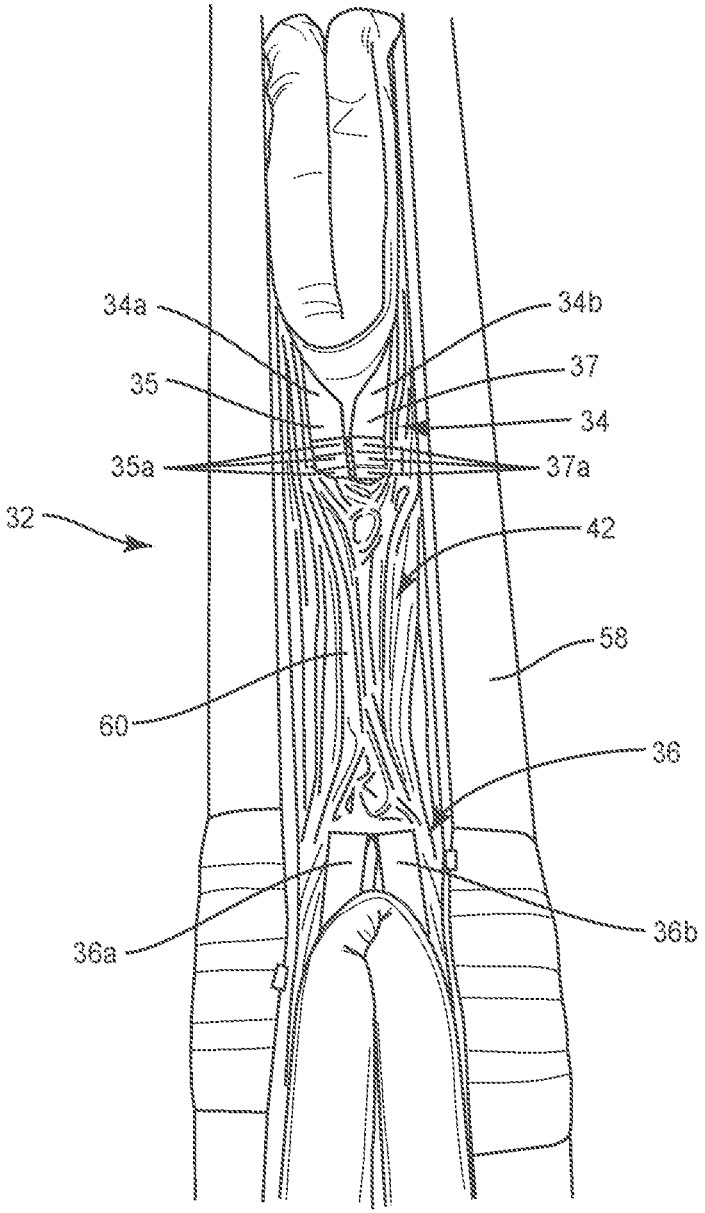
FIG. 9 is a perspective view of components of the mattress assembly shown in FIG. 1.

In some embodiments, an end 35 of section 34*a* includes a cavity 35*a* and an end 37 of section 34*b* include a cavity 37*a* (FIG. 9). Cavities 35*a*, 37*a* are each configured for disposal of a portion of one of hinges 46. In some embodiments, cavities 35*a*, 37*a* each include a single cavity. In some embodiments, cavities 35*a*, 37*a* each include a plurality of cavities. For example, in one embodiment, cavities 35*a*, 37*a* each include three cavities that are spaced apart from one another by a wall, as shown in FIG. 9.

Figure 4:
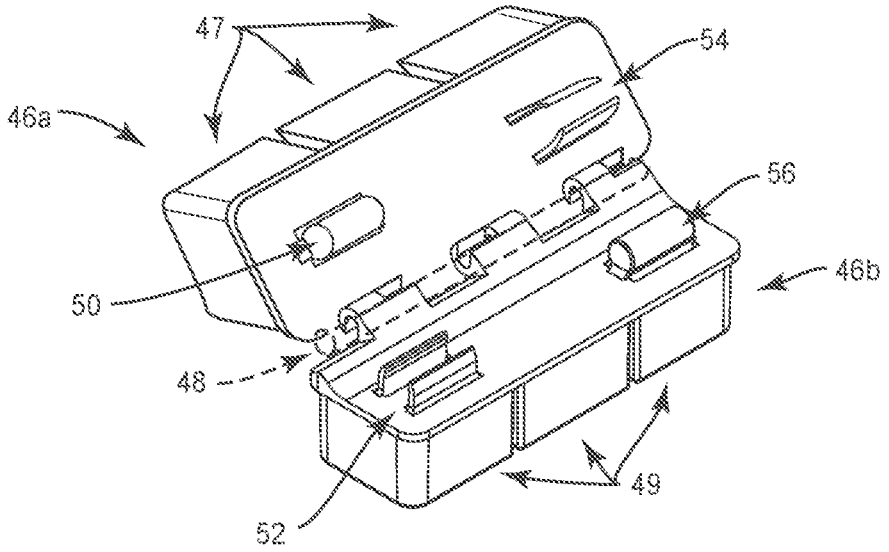
FIG. 4 is a perspective view, in part phantom, of a component of the mattress assembly shown in FIG. 1.
Figure 5:
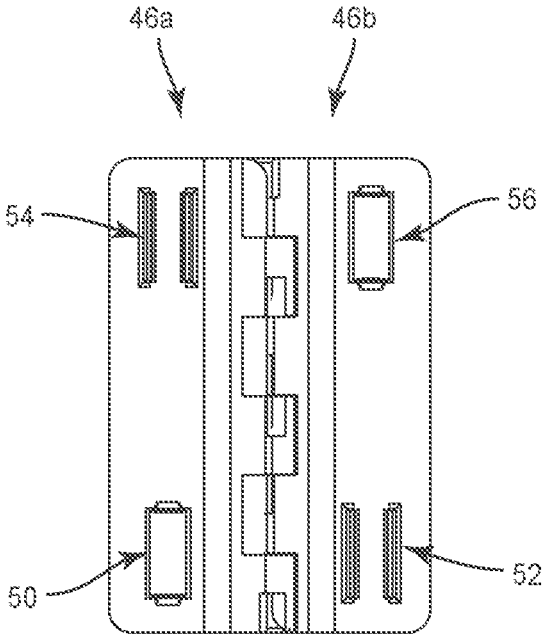
FIG. 5 is a top view of the component shown in FIG. 4.
Figure 6:
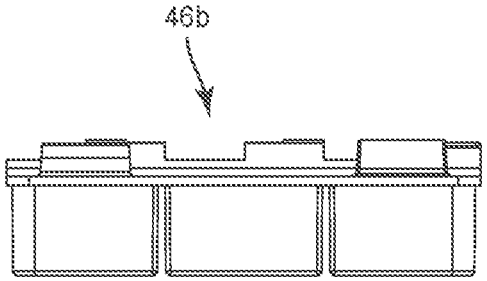
FIG. 6 is a side view of the component shown in FIG. 4.

In some embodiments, hinge 46 includes a first section 46*a* and a second section 46*b*, as shown in FIG. 4. A rod 48 extends through sections 46*a*, 46*b* to connect section 46*a* with section 46*b*. Section 46*a* is pivotable relative to section 46*b* about rod 48. Section 46*a* includes a plurality of spaced apart projections 47 that are configured for disposal in cavities 35*a* or cavities 37*a* and section 46*b* includes a plurality of spaced apart projections 49 that are configured for disposal in the other ones of cavities 35*a* or cavities 37*a*. Section 46*a* is pivotable relative to section 46*b* about rod 48 over a range a, as shown in FIG. 7. In some embodiments, range a is between 0 and about 180 degrees, between 0 and about 175 degrees, between 0 and about 170 degrees, between 0 and about 165 degrees, between 0 and about 160 degrees, between 0 and about 155 degrees, between 0 and about 150 degrees, between 0 and about 145 degrees, between 0 and about 140 degrees, between 0 and about 135 degrees, between 0 and about 130 degrees, between 0 and about 125 degrees, between 0 and about 120 degrees, between 0 and about 115 degrees, between 0 and about 110 degrees, between 0 and about 105 degrees, between 0 and about 100 degrees, between 0 and about 95 degrees, or between 0 and about 90 degrees. When section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, section 34*a* of wall 34 extends parallel to section 34*b* of wall 34. When section 46*a* of hinge 46 that connects section 34*a* of wall 34 with section 34*b* of wall 34 is disposed at an angle greater than 0 degrees relative to section 46*b* of hinge 46 that connects section 34*a* of wall 34 with section 34*b* of wall 34, section 34*a* of wall 34 extends transverse to section 34*b* of wall 34.

In some embodiments, when section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, a planar surface of section 46*a* engages a planar surface of section 46*b*. In some embodiments, when section 46*a* of hinge 46 that connects section 34*a* of wall 34 with section 34*b* of wall 34 is disposed at an angle of 0 degrees relative to section 46*b* of hinge 46 that connects section 34*a* of wall 34 with section 34*b* of wall 34, a locking element 50 of section 46*a* engages a locking element 52 of section 46*b* and a locking element 54 of section 46*a* engages a locking element 56 of section 46*b*. Locking element 50 comprises a cylindrical component that is positioned between spaced apart arms of locking element 52 and locking element 56 comprises a cylindrical component that is positioned between spaced apart arms of locking element 54. The arms of locking element 52 are resilient such that the arms of locking element 52 move apart from one another as the cylindrical component of locking element 50 is inserted between the arms of locking element 52. The arms of locking element 52 move towards one another when the cylindrical component of locking element 50 is inserted between the arms of locking element 52 to prevent the cylindrical component of locking element 50 from moving out of the space between the arms of locking element 52. Likewise, the arms of locking element 54 are resilient such that the arms of locking element 54 move apart from one another as the cylindrical component of locking element 56 is inserted between the arms of locking element 54. The arms of locking element 54 move towards one another when the cylindrical component of locking element 56 is inserted between the arms of locking element 54 to prevent the cylindrical component of locking element 56 from moving out of the space between the arms of locking element 54. This configuration provisionally fixes section 46*a* of hinge 46 that connects section 34*a* of wall 34 with section 34*b* of wall 34 relative to section 46*b* of hinge 46 that connects section 34*a* of wall 34 with section 34*b* of wall 34 when section 46*a* is disposed at an angle of 0 degrees relative to section 46*b*. That is, a force is required to pivot section 46*a* relative to section 46*b* to move the cylindrical portion of locking element 50 out of the space between the arms of locking element 52 and to move the cylindrical portion of locking element 56 out of the space between the arms of locking element 54. As the cylindrical portion of locking element 50 moves out of the space between the arms of locking element 52, the arms of locking element 52 move apart from one another and then snap back after the cylindrical portion of locking element 50 is removed from the space between the arms of locking element 52. As the cylindrical portion of locking element 56 moves out of the space between the arms of locking element 54, the arms of locking element 54 move apart from one another and then snap back after the cylindrical portion of locking element 56 is removed from the space between the arms of locking element 54. In some embodiments, second 46*a* includes only one locking element, such as, for example, locking element 50 and section 46*b* includes only one locking element, such as, for example, locking element 52.

In some embodiments, an end 39 of section 36*a* includes a cavity similar or identical to cavity 35*a* and an end 41 of section 36*b* include a cavity similar or identical to cavity 37*a*. The cavities in ends 39, 41 are each configured for disposal of a portion of hinge 46. In some embodiments, the cavities in ends 39, 41 each include a single cavity. In some embodiments, the cavities in ends 39, 41 each include a plurality of cavities. For example, in one embodiment, the cavities in ends 39, 41 each include three cavities that are spaced apart from one another by a wall.

Projections 47 of one of hinges 46 are configured for disposal in the cavities in end 39 or the cavities in end 41 and projections 49 of one of hinges 46 are configured for disposal in the other ones of the cavities in end 39 or the cavities in end 41. When section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, section 36*a* of wall 36 extends parallel to section 36*b* of wall 36. When section 46*a* of hinge 46 that connects section 36*a* of wall 36 with section 36*b* of wall 36 is disposed at an angle greater than 0 degrees relative to section 46*b* of hinge 46 that connects section 36*a* of wall 36 with section 36*b* of wall 36, section 36*a* of wall 36 extends transverse to section 36*b* of wall 36.

In some embodiments, when section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, a planar surface of section 46*a* engages a planar surface of section 46*b*. In some embodiments, when section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, locking element 50 of section 46*a* engages locking element 52 of section 46*b* and locking element 54 of section 46*a* engages locking element 56 of section 46*b*.

The configuration of hinge 46 that connects section 36*a* of wall 36 with section 36*b* of wall 36 provisionally fixes section 46*a* relative to section 46*b* when section 46*a* is disposed at an angle of 0 degrees relative to section 46*b*. That is, a force is required to pivot section 46*a* relative to section 46*b* to move the cylindrical portion of locking element 50 out of the space between the arms of locking element 52 and to move the cylindrical portion of locking element 56 out of the space between the arms of locking element 54. As the cylindrical portion of locking element 50 moves out of the space between the arms of locking element 52, the arms of locking element 52 move apart from one another and then snap back after the cylindrical portion of locking element 50 is removed from the space between the arms of locking element 52. As the cylindrical portion of locking element 56 moves out of the space between the arms of locking element 54, the arms of locking element 54 move apart from one another and then snap back after the cylindrical portion of locking element 56 is removed from the space between the arms of locking element 54.

Figure 7A:
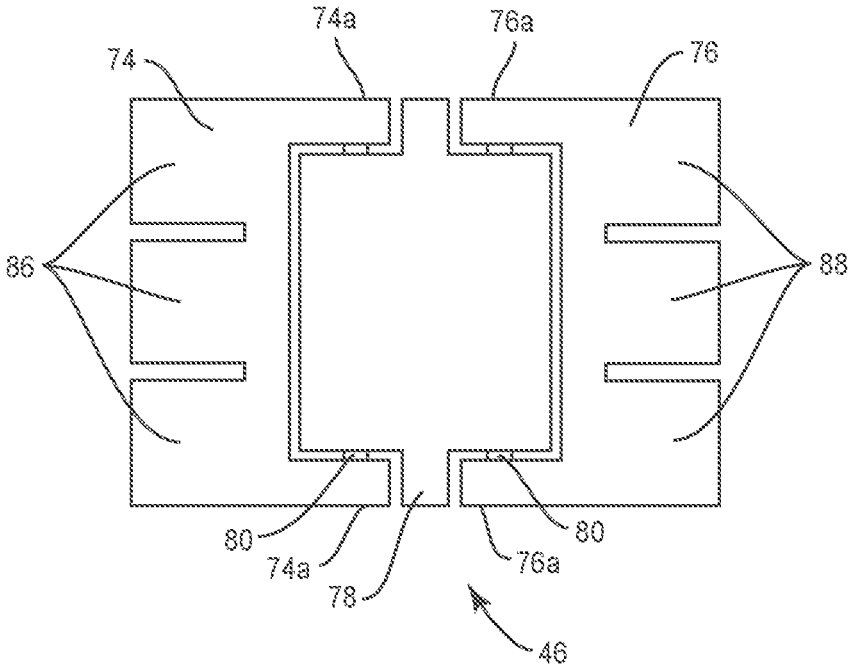
FIG. 7A is a side view of one embodiment of a component of the mattress assembly shown in FIG. 1.
Figure 7B:
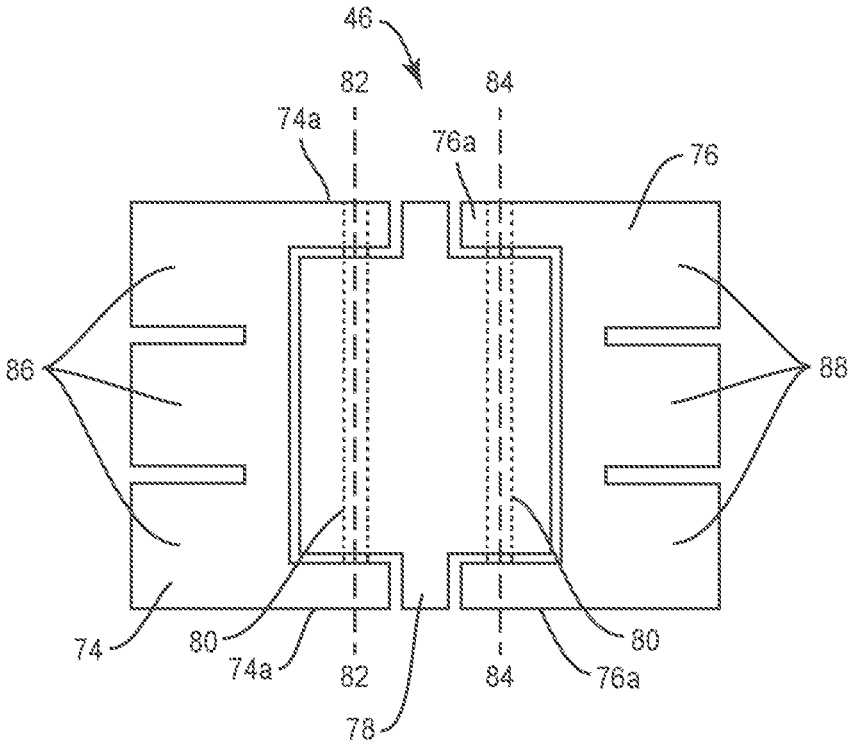
FIG. 7B is a side view, in part phantom, of the component shown in FIG. 7A.
Figure 8:
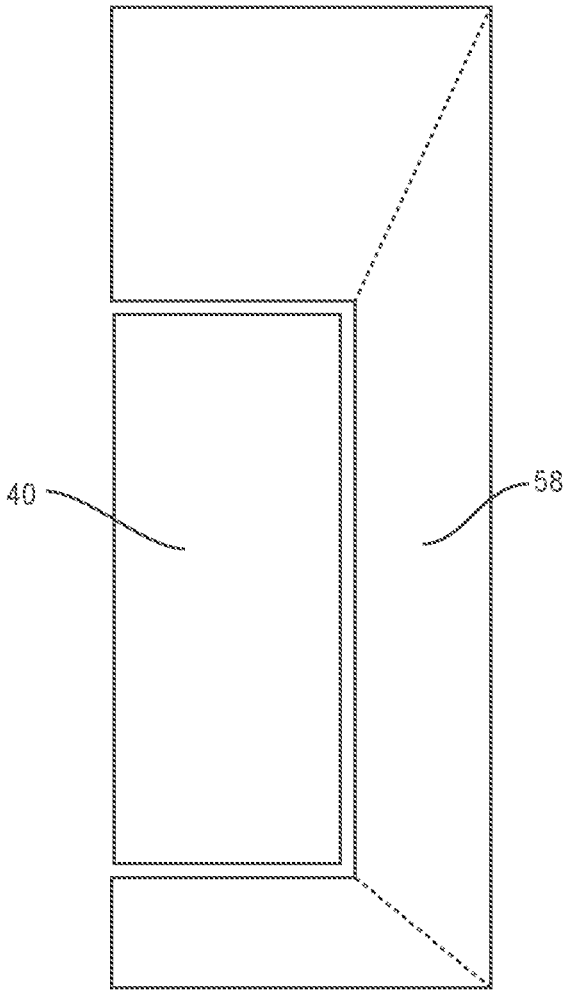
FIG. 8 is a side, cross sectional view of components of the mattress assembly shown in FIG. 1.

In some embodiments, shown in FIGS. 7A and 7B, hinge 46 includes a first section 74, a second section 76 and a middle section 78 between sections 74, 76. Section 74 includes a pair of spaced apart flanges 74*a* and section 76 includes a pair of spaced apart flanges 76*a*. A pin 80 extends through flanges 74*a* and section 78 such that section 74 is pivotable relative to section 78 about a pivot axis 82 defined by pin 80. Likewise, a pin 80 extends through flanges 76*a* and section 78 such that section 76 is pivotable relative to section 78 about a pivot axis 84 defined by the pin 80 that extends through flanges 76*a* and section 78. Section 74 includes a plurality of spaced apart projections 86 that are configured for disposal in cavities 35*a* or cavities 37*a* and section 76 includes a plurality of spaced apart projections 88 that are configured for disposal in the other ones of cavities 35*a* or cavities 37*a*.

In some embodiments, an end 39 of section 36*a* includes a cavity similar or identical to cavity 35*a* and an end 41 of section 36*b* include a cavity similar or identical to cavity 37*a*. The cavities in ends 39, 41 are each configured for disposal of a portion of hinge 46. In some embodiments, the cavities in ends 39, 41 each include a single cavity. In some embodiments, the cavities in ends 39, 41 each include a plurality of cavities. For example, in one embodiment, the cavities in ends 39, 41 each include three cavities that are spaced apart from one another by a wall.

Projections 47 of one of hinges 46 are configured for disposal in the cavities in end 39 or the cavities in end 41 and projections 49 of one of hinges 46 are configured for disposal in the other ones of the cavities in end 39 or the cavities in end 41. When section 46*a* of hinge 46 that connects section 36*a* of wall 36 with section 36*b* of wall 36 is disposed at an angle of 0 degrees relative to section 46*b* of hinge 46 that connects section 36*a* of wall 36 with section 36*b* of wall 36, section 36*a* of wall 36 extends parallel to section 36*b* of wall 36. When section 46*a* of hinge 46 that connects section 36*a* of wall 36 with section 36*b* of wall 36 is disposed at an angle greater than 0 degrees relative to section 46*b* of hinge 46 that connects section 36*a* of wall 36 with section 36*b* of wall 36, section 36*a* of wall 36 extends transverse to section 36*b* of wall 36.

In some embodiments, mattress assembly 30 does not include a cover or any material that is applied to the outer surfaces of walls 34, 36 and sidewalls 38, 40. In such embodiments, the outer surfaces of walls 34, 36 and sidewalls 38, 40 define an outermost surface of mattress assembly 30. In some embodiments, chassis 32 comprises a cover 58 that covers at least the outer surfaces of walls 34, 36 and sidewalls 38, 40 such that cover 58 defines an outermost surface of mattress assembly 30. In some embodiments, cover 58 may also cover the upper and lower surfaces of walls 34, 36 and sidewalls 38, 40. For example, cover 58 covers the upper and lower surfaces of sidewall 40 in FIG. 8. As would be apparent to one of ordinary skill in the art, cover 58 can also be configured to cover the upper and lower surfaces of walls 34, 36 and sidewall 38 in the same manner that cover 58 covers the upper and lower surfaces of sidewall 40 in FIG. 8. Walls 34, 36 and sidewalls 38, 40 will thus be spaced apart from the box spring by cover 58 when mattress assembly 30 is positioned on top of the box spring. Chassis 32 is shown in FIGS. 1-3, 12, 16 and 19 without cover, for clarity. Cover 58 is shown in FIGS. 8-11 and 13 to show how cover 58 is positioned on walls 34, 36 and sidewalls 38, 40. In some embodiments, cover 58 covers at least one of hinges 44 and/or hinges 46. In some embodiments, cover 58 comprises a fabric, such as, for example, stretch fabric.

Figure 10:
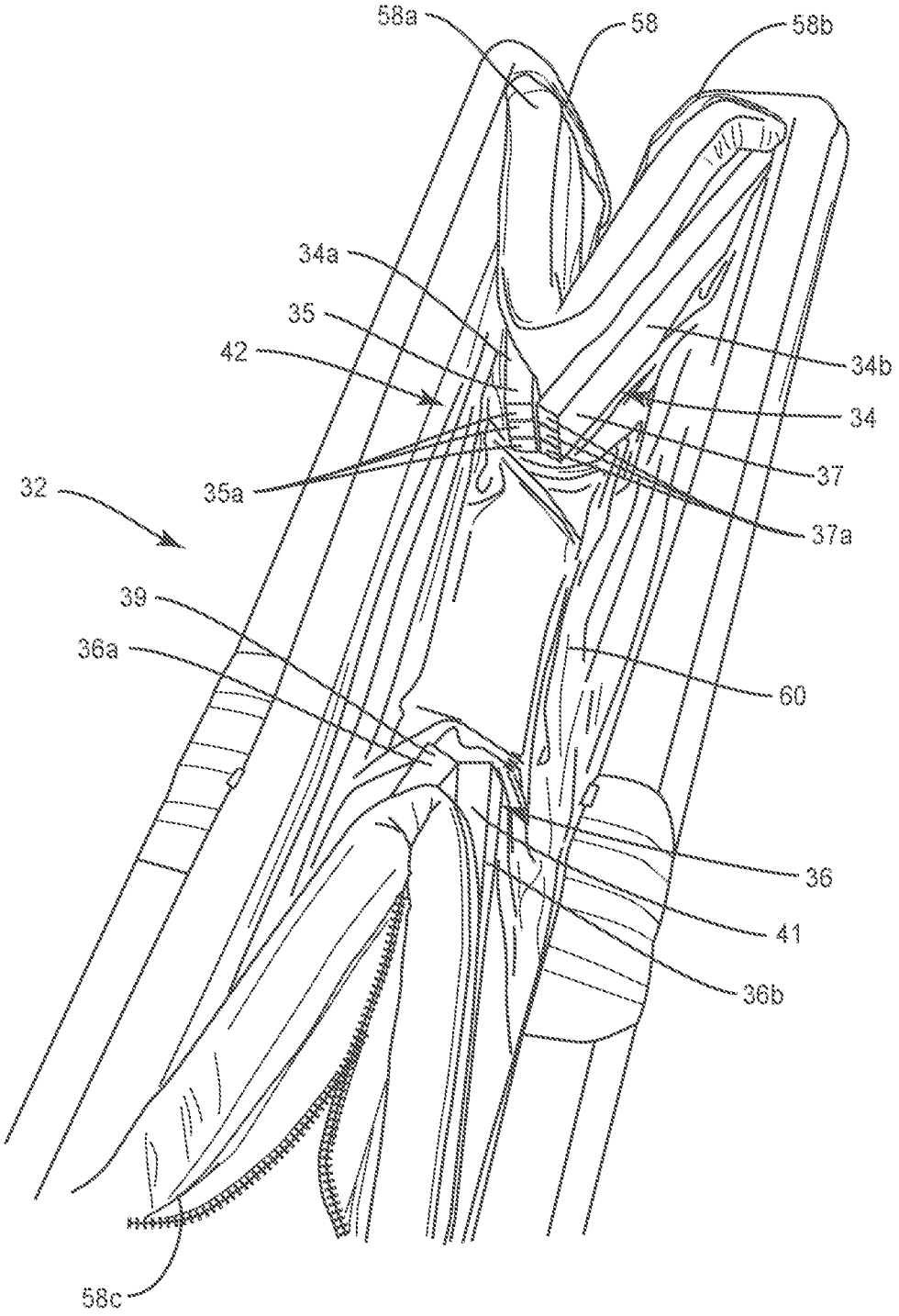
FIG. 10 is a perspective view of components of the mattress assembly shown in FIG. 1.

In some embodiments, cover 58 comprises a cushioning material 58*a* within a fabric pocket, as shown in FIG. 10, for example. In some embodiments, cushioning material 58*a* is a fiber foam-cushioning layer that is disposed about the inner, upper and lower surfaces of walls 34, 36 and sidewalls 38, 40. Cushioning material 58*a* is disposed in a fabric pocket 58*b*. In some embodiments, cover 58 is permanently fixed to walls 34, 36 and sidewalls 38, 40 such that cover 58 cannot be removed from walls 34, 36 and sidewalls 38, 40 without destroying or otherwise damaging cover 58. In some embodiments, cover 58 is removeably coupled to walls 34, 36 and sidewalls 38, 40 to allow cover 58 to be removed from walls 34, 36 and sidewalls 38, 40 in order to clean cover 58, for example.

In some embodiments, interior cavity 42 extends continuously through opposite upper and lower surfaces of walls 34, 36 and sidewalls 38, 40. In some embodiments, chassis 32 comprises a base layer 60 that extends from the lower surfaces of walls 34, 36 and sidewalls 38, 40 to define a lower limit of interior cavity 42. Base layer 60 extends continuously from wall 34 to wall 36 and from sidewall 38 to sidewall 40. Walls 34, 36 and sidewalls 38, 40 define a perimeter of chassis 32. Base layer 60 perimetrically bounds chassis 32. Base layer 60 is permanently fixed to walls 34, 36 and sidewalls 38, 40 such that base layer cannot be removed from walls 34, 36 and sidewalls 38, 40 without destroying or otherwise damaging base layer 60. This allows base layer 60 to move with walls 34, 36 and/or sidewalls 38, 40 as sections 34*a*, 34*b* of wall 34 move relative to one another and sections 36*a*, 36*b* of wall 36 move relative to one another and/or sidewalls 38, 40 move relative to walls 34, 36, as discussed herein.

In some embodiments, base layer 60 includes a plurality of zones wherein each of the zones has a different permeability. For example, base layer 60 may include a first zone 60*a*, a second zone 60*b* and a third zone 60*c*, as shown in FIG. 11A. Zone 60*a* is more or less permeable than zone 60*b* and zone 60*b* is more or less permeable than zone 60*c*. This configuration allows air to move more quickly through certain portions of base layer 60 than other portions of base layer 60. This may facilitate moving air away from a sleep surface defined by a mattress topper to prevent heat from building up on the sleep surface. That is, the permeability of at least one of zones 60*a*, 60*b*, 60*c* will allow air to move downward from the sleep surface and to exit mattress assembly 30 through base layer 60.

Figure 2:
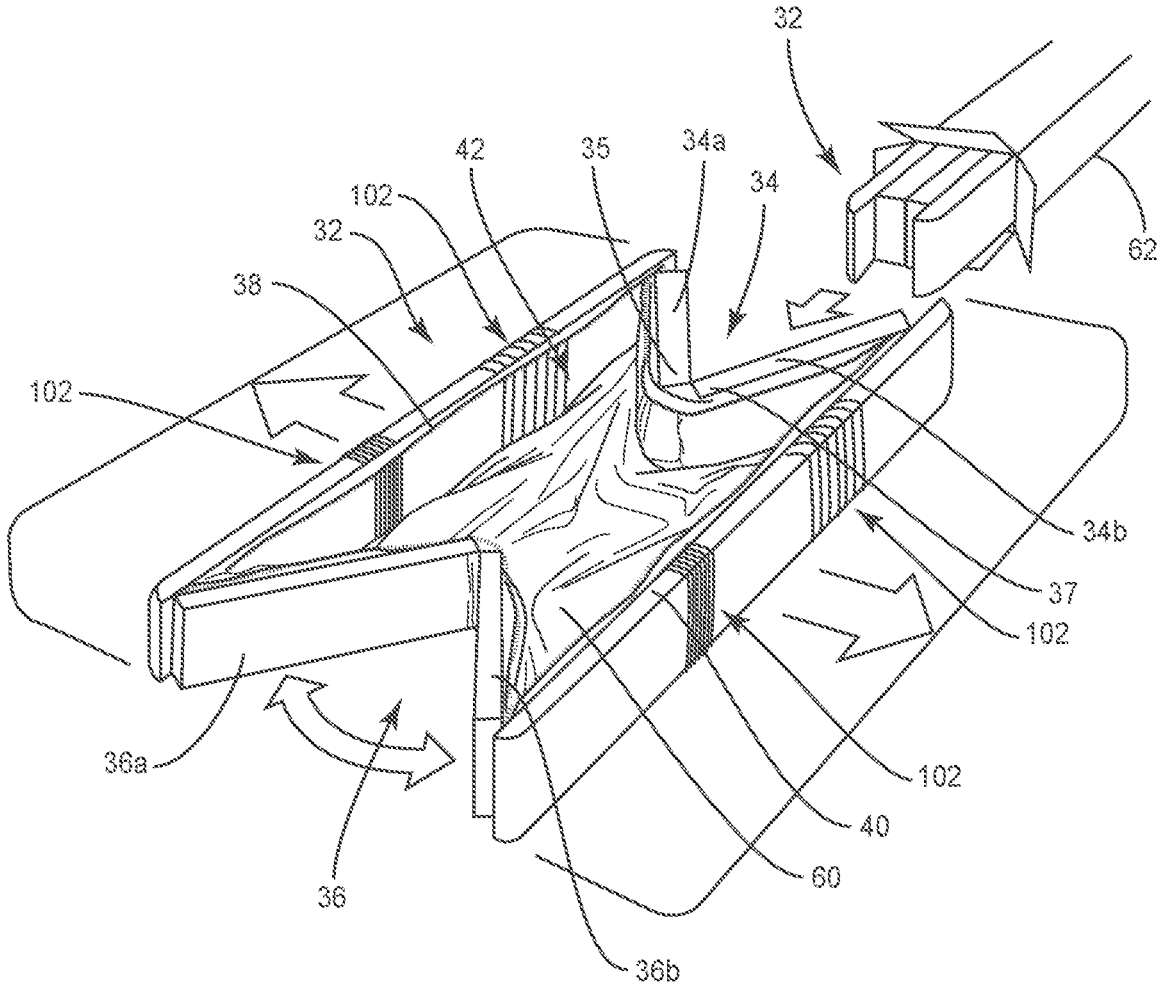
FIG. 2 is a perspective view of components of the mattress assembly shown in FIG. 1.

Chassis 32 is configured to be packaged in a container, such as, for example, a box 62 shown in FIG. 2. Box 62 has a size that permits box 62 to be shipped via ground shipping. That is, box 62 does not need to be shipped as freight. For example, box 62 may be less than 165 inches in length and girth combined. In some embodiments, box 62 is less than 108 inches in length. In some embodiments, box 62 is about 12"x12"x80" and weighs less than 125 when chassis 32 is packaged within box 62. This allows box 62 to be shipped as a United Parcel Service (UPS) small pack, for example.

When chassis 32 is packaged within box 62, chassis 32 is in a compacted configuration such that sections 34*a*, 34*b* of wall 34 and sections 36*a*, 36*b* of wall 36 each extend parallel to sidewalls 38, 40 and sidewalls 38, 40 extend parallel to one another, as shown in FIG. 2. Chassis 32 may be positioned on top of the box spring and moved from the compacted configuration to an expanded configuration. To move chassis 32 from the compacted configuration to the expanded configuration, sections 34*a*, 36*a* of walls 34, 36 are pivoted about hinges 44 to pivot sections 34*a*, 36*a* relative to sidewall 38 and sections 34*b*, 36*b* of walls 34, 36 are pivoted about hinges 44 to pivot sections 34*b*, 36*b* relative to sidewall 40 such that sections 34*a*, 34*b*, 36*a*, 36*b* each extend at an acute angle relative to sidewalls 38, 40, as shown in FIGS. 2, 9 and 10. As sections 34*a*, 34*b*, 36*a*, 36*b* pivot relative to sidewalls 38, 40, section 34*a* of wall 34 pivots relative to section 34*b* of wall 34 about hinge 46 that connects sections 34*a*, 34*b* and section 36*a* of wall 36 pivots relative to section 36*b* of wall 36 about hinge 46 that connects sections 36*a*, 36*b* such that section 34*a* extends transverse to section 34*b* and section 36*a* extends transverse to section 36*b*, as also shown in FIGS. 2, 9 and 10.

Figure 11:
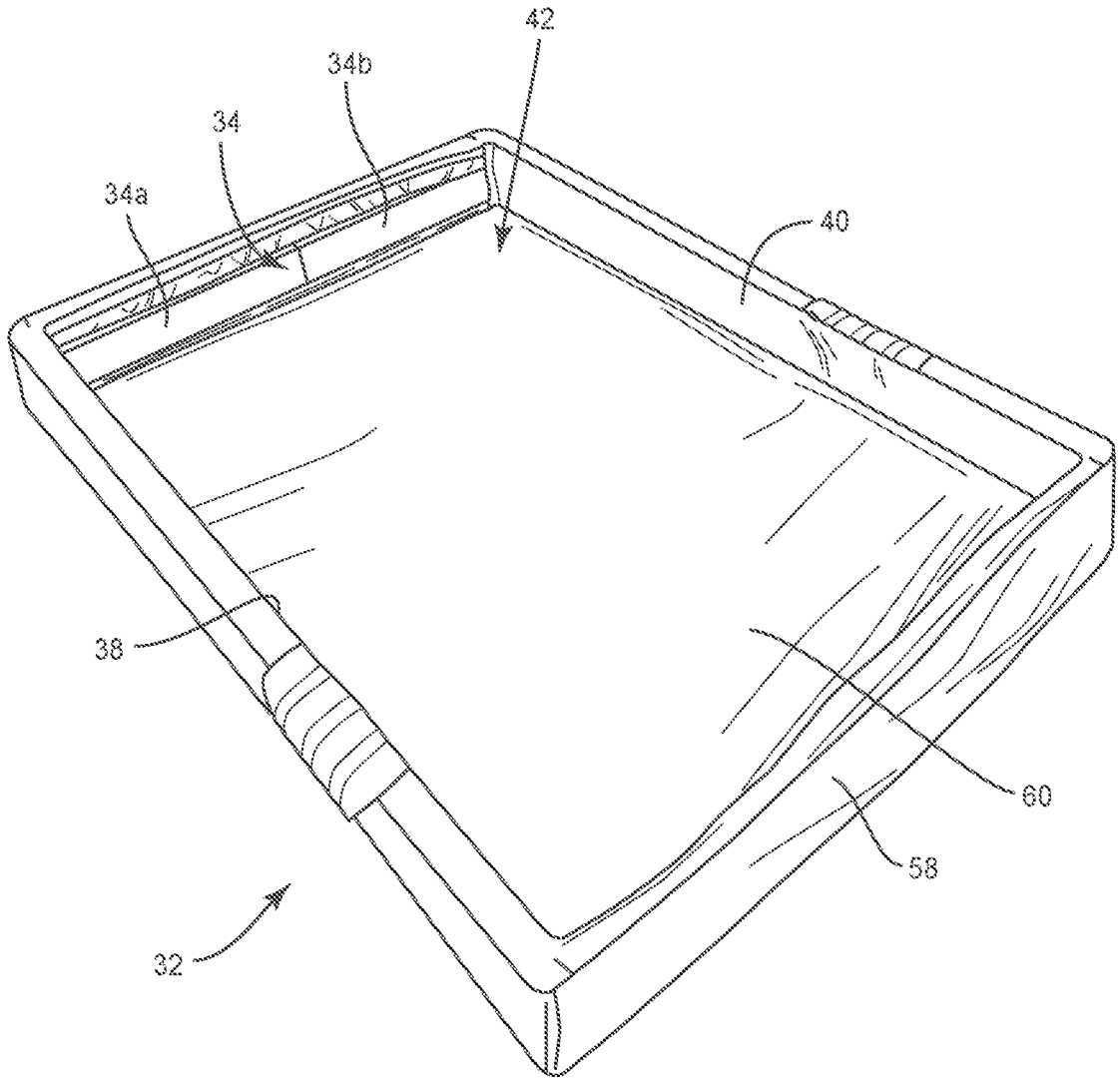
FIG. 11 is a perspective view of components of the mattress assembly shown in FIG. 1.
Figure 11A:
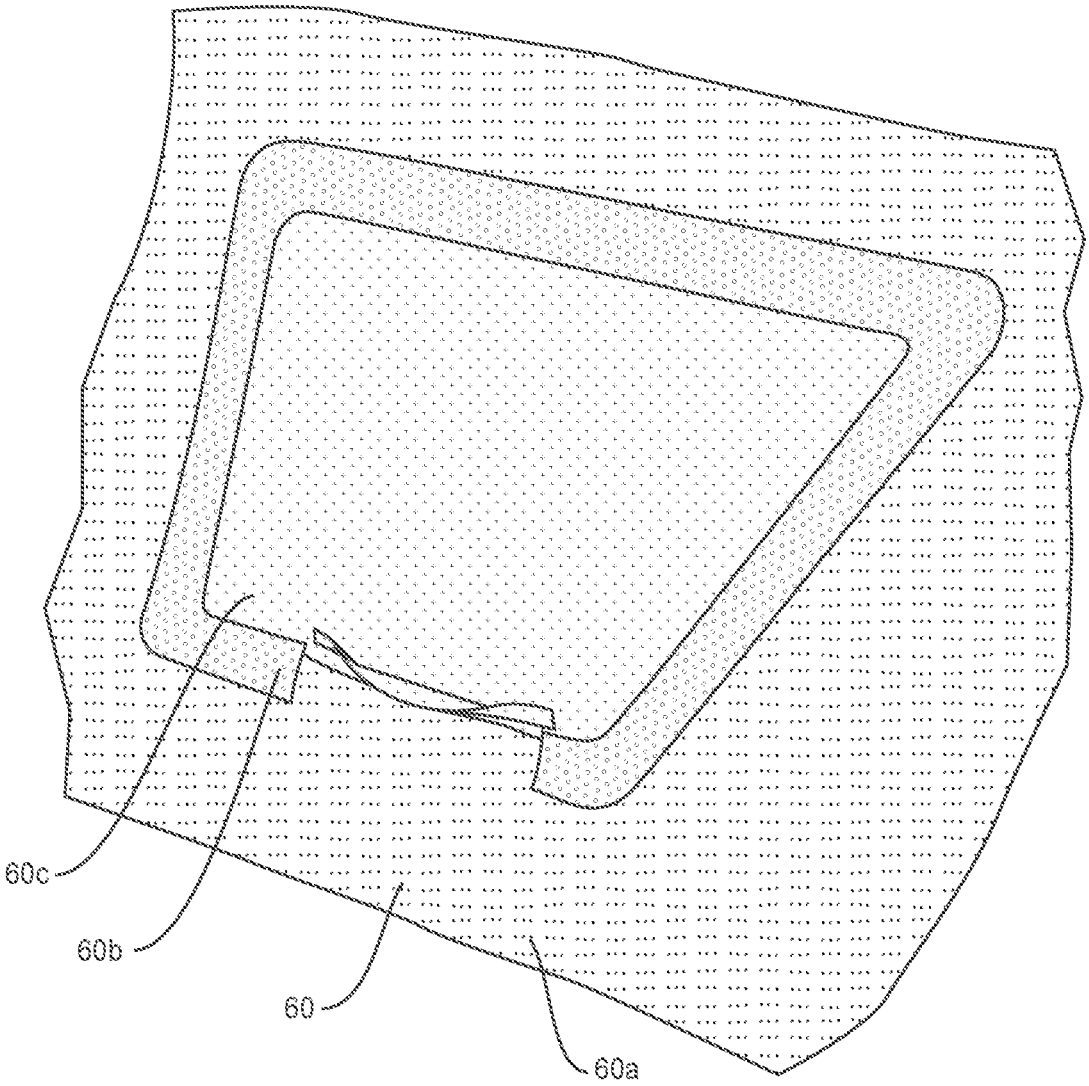
FIG. 11A is a top view of one embodiment of a component of the mattress assembly shown in FIG. 1.
Figure 12:
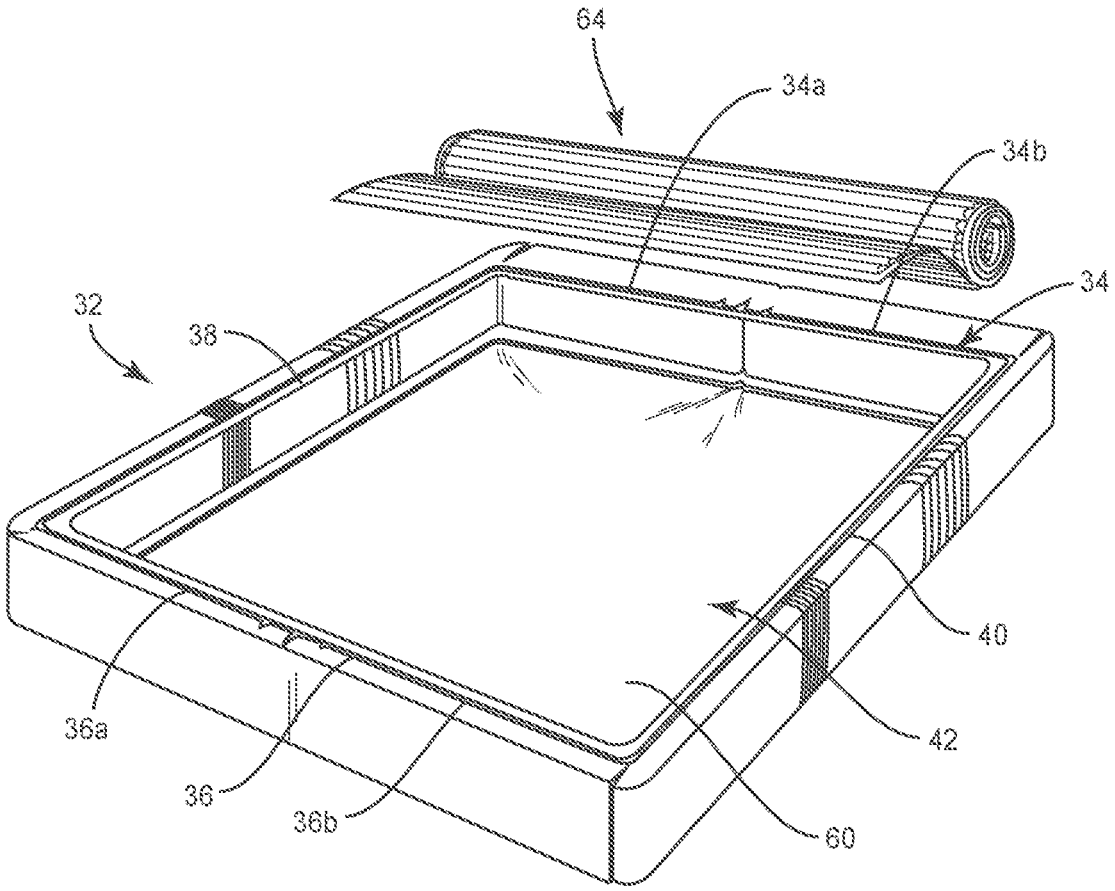
FIG. 12 is a perspective view of components of the mattress assembly shown in FIG. 1.
Figure 13:
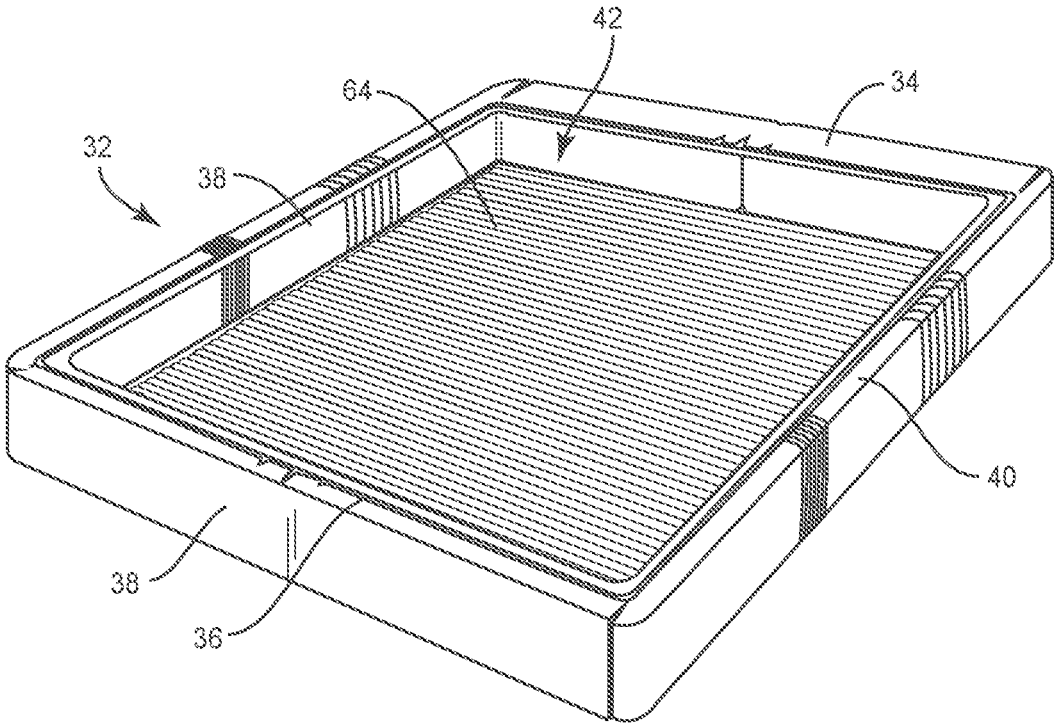
FIG. 13 is a perspective view of components of the mattress assembly shown in FIG. 1.

Sections 34*a*, 34*b*, 36*a*, 36*b* are pivoted relative to sidewalls 38, 40 about hinges 44, section 34*a* is pivoted relative to section 34*b* about hinge 46 that connects sections 34*a*,

34*b* and section 36*a* is pivoted relative to section 36*b* about hinge 46 that connects section 36*a*, 36*b* until sections 34*a*, 34*b* extend parallel to one another, sections 36*a*, 36*b* extend parallel to one another and sections 34*a*, 34*b*, 36*a*, 36*b* extend perpendicular to sidewalls 38, 40, as shown in FIGS. 11-13. When sections 34*a*, 34*b* extend parallel to one another, sections 36*a*, 36*b* extend parallel to one another and sections 34*a*, 34*b*, 36*a*, 36*b* extend perpendicular to sidewalls 38, 40, chassis 32 is in the expanded configuration.

In some embodiments, one or a plurality of spring packs are positioned on top of base layer 60 such that bottom surfaces of the spring packs engage a top surface of base layer 60. In some embodiments, chassis 32 includes a tambor 64 that is removeably positioned within interior cavity 42 when chassis 32 is in the expanded configuration. Tambor 64 is movable between a rolled configuration, shown in FIG. 12 and an unrolled configuration, shown in FIG. 13. In some embodiments, tambor 64 may be packaged in box 62 with the other components of chassis 32 (e.g., walls 34, 36, sidewalls 38, 40, cover 58 and base layer 60). Including tambor 64 in box 62 will not increase the size of box from that discussed above and will not cause box 62 to weigh more than 125 pounds. Tambor 64 is packaged within box 62 when tambor 64 is in the rolled configuration. Tambor 64 may be positioned within interior cavity 42 on top of base layer 60 in the rolled configuration and then moved from the rolled configuration to the unrolled configuration, as shown in FIG. 13.

Figure 14:
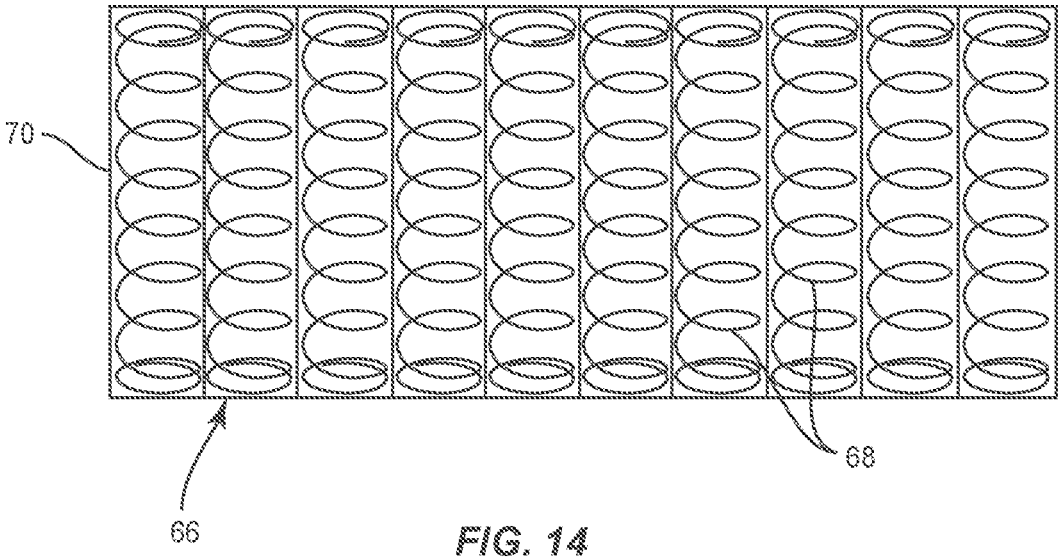
FIG. 14 is a side view, in part phantom, of one embodiment of a component of the mattress assembly shown in FIG. 1, in accordance with the principles of the present disclosure.
Figure 15:
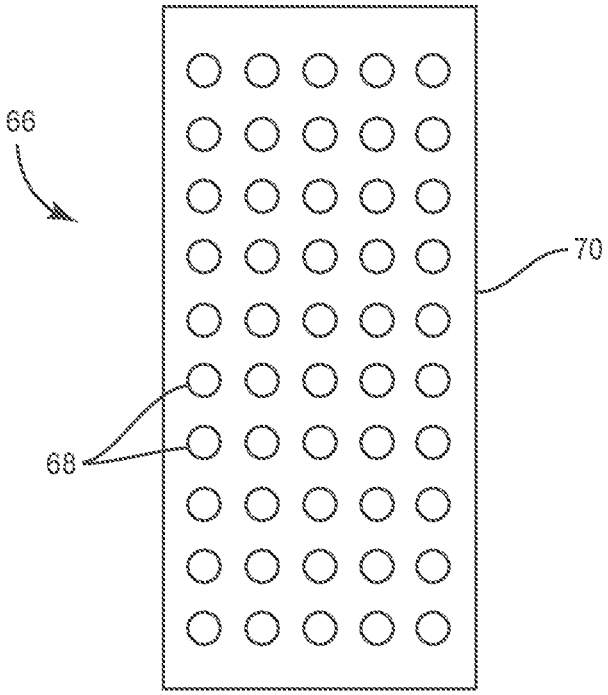
FIG. 15 is a top view, in part phantom, of the component of the mattress assembly shown in FIG. 14.
Figure 16:
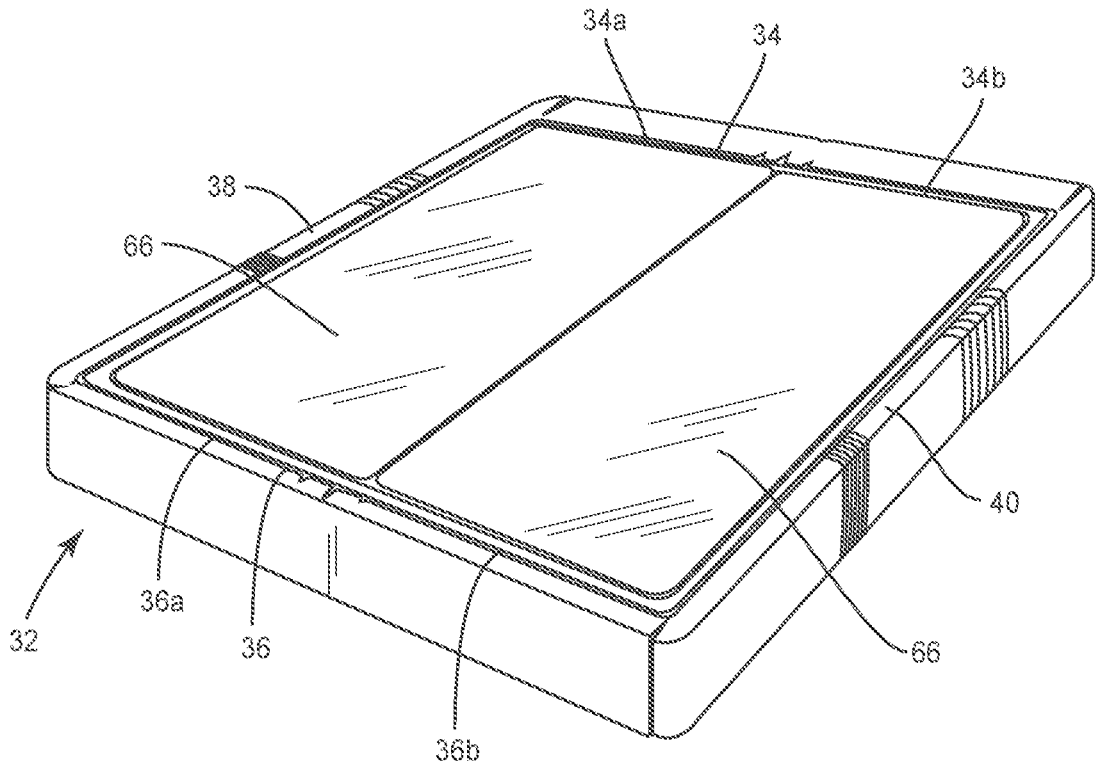
FIG. 16 is a perspective view of components of the mattress assembly shown in FIG. 1.

As shown in FIGS. 14-16, one or a plurality of spring packs, such as, for example, spring pack 66 is/are positioned within interior cavity 42. In embodiments that do not include tambor 64 or base layer 60, spring pack 66 is positioned directly on top of the box spring such that a bottom surface of spring pack 66 engages the top surface of the box spring. In embodiments that do not include tambor 64, spring pack 66 is positioned directly on top of base layer 60 such that the bottom surface of spring pack 66 engages the top surface of base layer 60. In embodiments that include tambor 64, spring pack 66 is positioned directly on top of tambor 64 such that the bottom surface of spring pack 66 engages the top surface of tambor 64. When spring pack 66 is positioned within interior cavity 42, side surfaces of spring pack 66 engage the inner surfaces of walls 34, 36 and sidewalls 38, 40 that define interior cavity 42.

In some embodiments, spring pack 66 comprises a plurality of springs 68 positioned within a pouch 70. Springs 68 are enclosed within pouch 70. Spring pack 66 comprises one or a plurality of rows of springs 68 and one or a plurality of columns of springs 68. As shown in FIG. 15, spring pack includes a plurality of rows of springs 68 and a plurality of columns of springs 68. In some embodiments, spring pack 66 includes a plurality of strings of springs, as described in U.S. Patent Application Ser. No. 62/347,199 to the inventor of the current application, which is incorporated by reference herein, in its entirety. In some embodiments, springs 68 are each positioned within a pocket, such as, for example, a fabric pocket. The pockets may be coupled to one another to form a string of pockets that each include one of springs 68 therein. In some embodiments, the sting of pockets includes one or more slits between adjacent pockets to allow springs 68 to move independently of one another. In some embodiments, the sting of pockets includes one or more slits that extend through a top surface of the string of pockets between adjacent pockets and/or one or more slits that extend through a bottom surface of the string of pockets between adjacent pockets.

In some embodiments, spring pack 66 includes two spring packs 66*a*, 66*b*, as shown in FIG. 16. Spring pack 66*a* is positioned on one side of mattress assembly 30 and spring pack 66*b* is positioned on an opposite side of mattress assembly 30. In some embodiments, spring pack 66*a* is identical to spring pack 66*b*. In some embodiments, spring pack 66*a* includes springs 68 that are different from springs 68 of spring pack 66*b* such that spring pack 66*a* is more or less firm than spring pack 66*b*. In some embodiments, springs 68 of spring pack 66*a* may include more or less coils than springs 68 of spring pack 66*b*. In some embodiments, springs 68 of spring pack 66*a* may include coils having a different gauge than the coils of springs 68 of spring pack 66*b*. In some embodiments, springs 68 of spring pack 66*a* may include different coils than the coils of springs 68 of spring pack 66*b*. For example, springs 68 of spring pack 66*a* may include continuous coils, bonnell coils, offset coils and marshall coils and spring pack 66*b* may include springs 68 having coils that are different than the coils of springs 68 of spring pack 66*a*. Using different springs 68 in spring pack 66*a* than spring pack 66*b* allows mattress assembly 30 to be customized based on preference. For example, if a sleeper that sleeps on the side of mattress assembly 30 adjacent sidewall 38 desires a firmer sleep surface than a sleeper that sleeps on the side of mattress assembly 30 adjacent sidewall 40, spring pack 66*a* can be configured to be firmer than spring pack 66*b*. Likewise, if the sleeper that sleeps on the side of mattress assembly 30 adjacent sidewall 38 desires a sleep surface that is less firm than the sleeper that sleeps on the side of mattress assembly 30 adjacent sidewall 40, spring pack 66*a* can be configured to be less firm than spring pack 66*b*.

Figure 17:
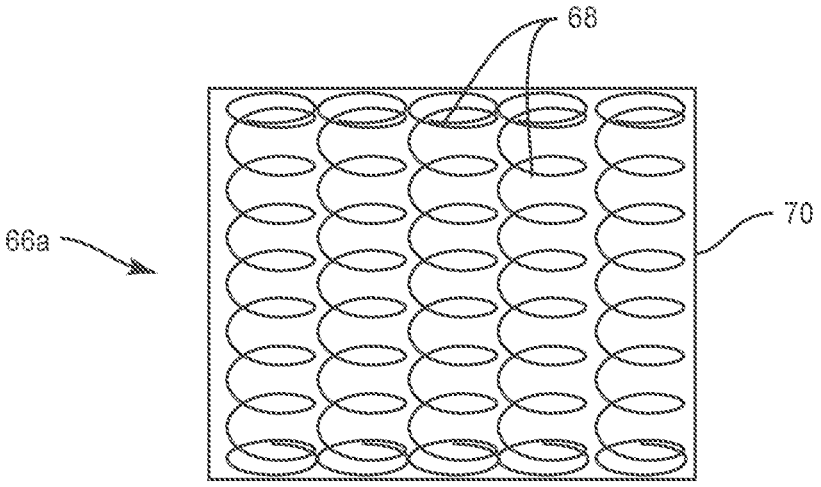
FIG. 17 is a side view, in part phantom, of one embodiment of a component of the mattress assembly shown in FIG. 1, in accordance with the principles of the present disclosure.
Figure 18:
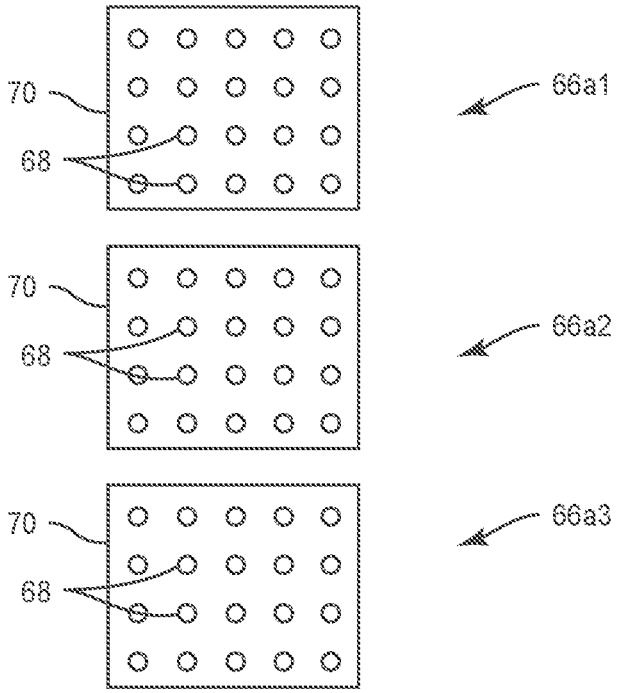
FIG. 18 is a top view, in part phantom, of the component of the mattress assembly shown in FIG. 17.
Figure 19:
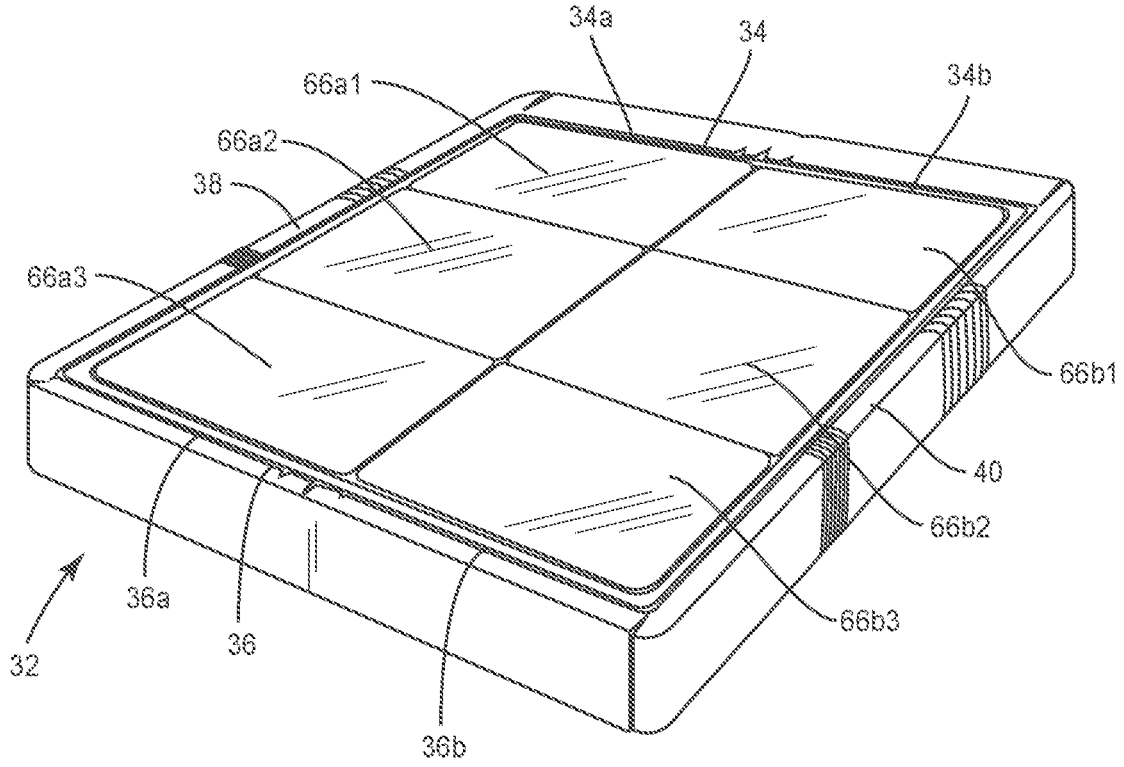
FIG. 19 is a perspective view of components of the mattress assembly shown in FIG. 17.

In some embodiments, at least one of spring packs 66*a*, 66*b* include a plurality of spring packs, as shown in FIGS. 17-19. For example, spring pack 66*a* may include a first spring pack 66*a*1, a second spring pack 66*a*2 and a third spring pack 66*a*3. Likewise, spring pack 66*b* may include a first spring pack 66*b*1, a second spring pack 66*b*2 and a third spring pack 66*b*3. Spring packs 66*a*1, 66*b*1 are configured to be positioned adjacent wall 34; spring packs 66*a*3, 66*b*3 are configured to be positioned adjacent wall 36; and spring packs 66*a*3, 66*b*3 are configured to be positioned between spring packs 66*a*1, 66*a*3 and between spring packs 66*b*1, 66*b*3, as shown in FIG. 19. Spring packs 66*a*1, 66*b*1 are each configured to support a sleeper's head and/or upper body; spring packs 66*a*2, 66*b*2 are each configured to support a sleeper's torso and/or core; and spring packs 66*a*3, 66*b*3 are each configured to support a sleepers legs and/or lower body.

In some embodiments, spring pack 66*a*1 is identical to spring pack 66*a*2 and spring pack 66*a*3. In some embodiments, spring pack 66*a*1 includes springs 68 that are different than springs 68 of spring pack 66*a*2 and/or spring pack 66*a*3 such that spring pack 66*a*1 is more or less firm than spring pack 66*a*2 and/or spring pack 66*a*3. That is, spring packs 66*a*1, 66*a*2, 66*a*3 can all have the same firmness, or one of spring packs 66*a*1, 66*a*2, 66*a*3 can have a firmness that is different from at least one of spring packs 66*a*1, 66*a*2, 66*a*3. As such, spring packs 66*a*1, 66*a*2, 66*a*3 can each have a different firmness, if desired. This allows a sleeper to select a spring pack 66*a*1 that has the firmness he or she desires to support his or her head and/or upper body, a spring pack 66*a*2 that has a firmness he or she desires to support his or her torso and/or core and a spring pack 66*a*3 that has a firmness he or she desires to support his or her legs and/or lower body. In some embodiments, springs 68 of spring pack 66*a*1 may include more or less coils than springs 68 of spring pack 66*a*2 and/or spring pack 66*a*3. In some embodiments, springs 68 of spring pack 66*a*1 may include coils having a different gauge than the coils of springs 68 of spring pack 66*a*2 and/or spring pack 66*a*3.

In some embodiments, spring pack 66*b*1 is identical to spring pack 66*b*2 and spring pack 66*b*3. In some embodiments, spring pack 66*b*1 includes springs 68 that are different than springs 68 of spring pack 66*b*2 and/or spring pack 66*b*3 such that spring pack 66*b*1 is more or less firm than spring pack 66*b*2 and/or spring pack 66*b*3. That is, spring packs 66*b*1, 66*b*2, 66*b*3 can all have the same firmness, or one of spring packs 66*b*1, 66*b*2, 66*b*3 can have a firmness that is different from at least one of spring packs 66*b*1, 66*b*2, 66*b*3. As such, spring packs 66*b*1, 66*b*2, 66*b*3 can each have a different firmness, if desired. This allows a sleeper to select a spring pack 66*b*1 that has the firmness he or she desires to support his or her head and/or upper body, a spring pack 66*b*2 that has a firmness he or she desires to support his or her torso and/or core and a spring pack 66*b*3 that has a firmness he or she desires to support his or her legs and/or lower body. In some embodiments, springs 68 of spring pack 66*b*1 may include more or less coils than springs 68 of spring pack 66*b*2 and/or spring pack 66*b*3. In some embodiments, springs 68 of spring pack 66*b*1 may include coils having a different gauge than the coils of springs 68 of spring pack 66*b*2 and/or spring pack 66*b*3.

Providing a plurality of spring packs that can be selected based on desired firmness allows a sleeper that sleeps adjacent to sidewall 38 and a sleeper that sleeps adjacent to sidewall 40 to each select a spring pack that that has the firmness he or she desires to support his or her head and/or upper body, a spring pack that has a firmness he or she desires to support his or her torso and/or core and a spring pack that has a firmness he or she desires to support his or her legs and/or lower body, even if the preference(s) of one of the sleepers is different than the preference(s) of the other sleeper. Furthermore, providing a plurality of spring packs that can be selected based on desired firmness allows one or more of the spring packs to be replaced if one of the spring packs wears out or if a user's preference changes over time. For example, should a sleeper desire a spring pack that is less firm than previously thought, the sleeper may replace the firm spring pack with a spring pack that is less firm.

Figure 20:
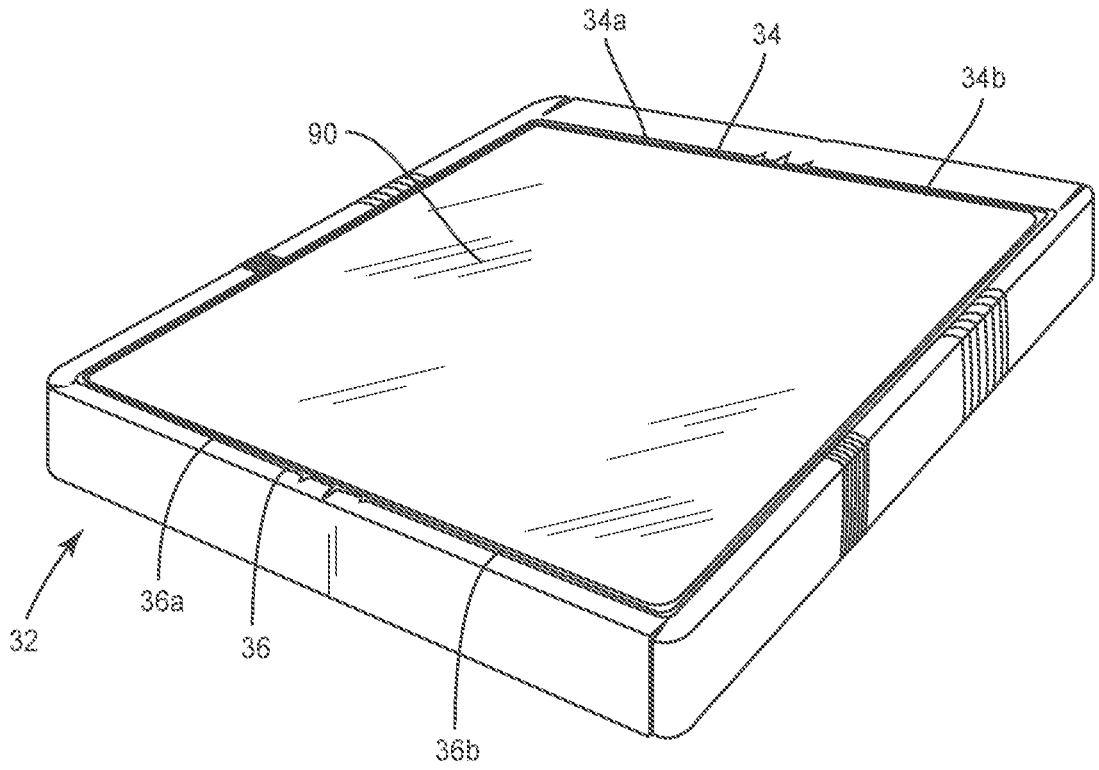
FIG. 20 is a perspective view of components of the mattress assembly shown in FIG. 1.
Figure 21:
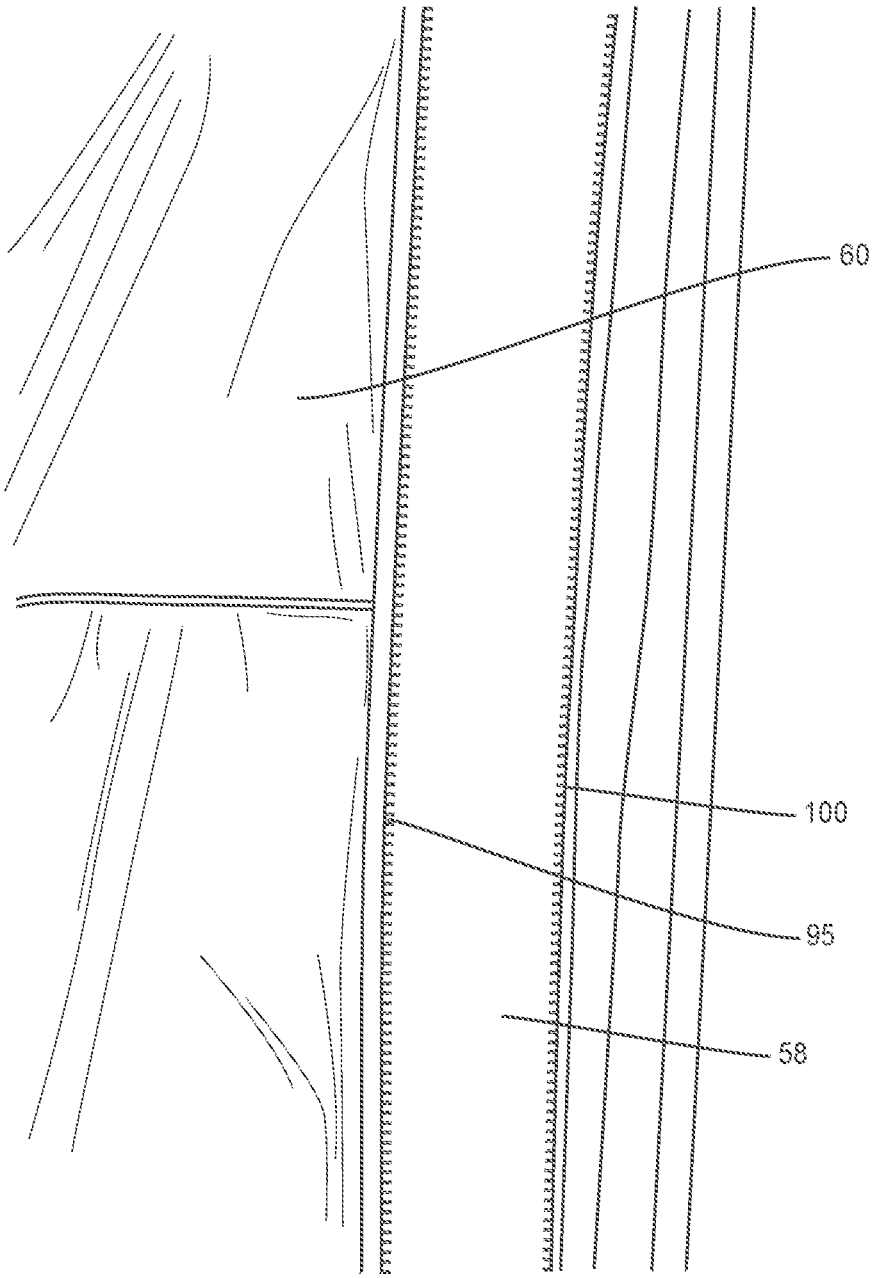
FIG. 21 is a top view of components of the mattress assembly shown in FIG. 1.

In some embodiments, mattress assembly 30 includes suspension fabric, such as, for example, a barrier layer 90 that covers spring pack 66, as shown in FIG. 20. Barrier layer 90 may be formed from one or more of the materials discussed herein. In some embodiments, barrier layer 90 is coupled to cover 58. In such embodiments, cover 58 may include an inner row of teeth 95 (FIG. 21) that mate and/or interlock with a row of teeth on a perimeter of barrier layer 90 such that inner row of teeth 95 and the teeth on the perimeter of barrier layer 90 form a zipper. The zipper may include a slider that is movable relative to inner row of teeth 95 and the teeth on the perimeter of barrier layer 90 to mesh together or separate inner row of teeth 95 and the teeth on the perimeter of barrier layer 90. In some embodiments, inner row of teeth 95 extends circumferentially about cover 58 such that the zipper formed by inner row of teeth 95 and the teeth on the perimeter of barrier layer 90 extends circumferentially about chassis 32.

Figure 22:
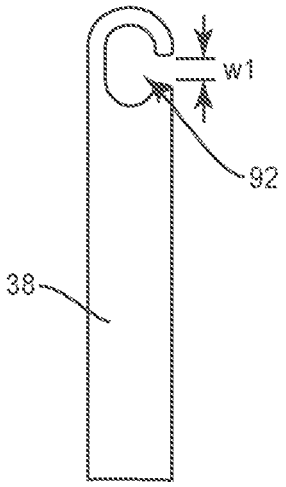
FIG. 22 is a side, cross sectional view of a component of the mattress assembly shown in FIG. 1.
Figure 23:
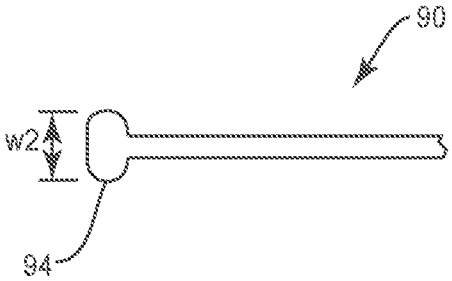
FIG. 23 is a side view of a component of the mattress assembly shown in FIG. 1.
Figure 24:
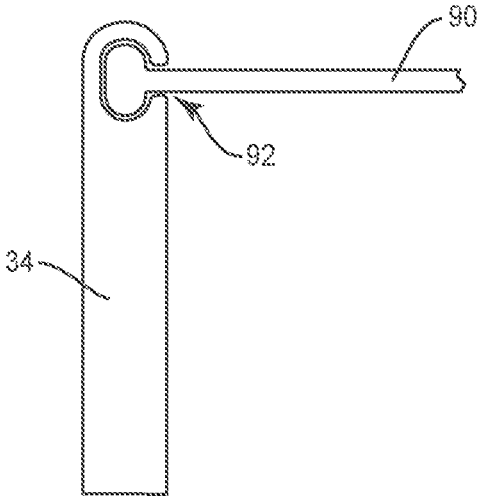
FIG. 24 is a side view, in part cross section, of components of the mattress assembly shown in FIG. 1.

In some embodiments, barrier layer 90 is coupled to chassis 32. In such embodiments, at least one of walls 34, 36, 38, 40 include a channel 92 and barrier layer 90 includes an enlarged edge portion 94 that is configured for disposal in channels 92, as shown in FIGS. 22-24. In some embodiments, edge portion 94 extends continuously about the entire perimeter of barrier layer 90. In some embodiments, channels 92 each extend the entire length of at least one of at least one of walls 34, 36, 38, 40. An opening 96 in at least one of walls 34, 36, 38, 40 is in communication with a respective one of channels 92 and has a width w1 that is less than a width w2 of edge portion 94 such that edge portion 94 cannot be removed from channels 92.

In some embodiments, a first section of barrier layer 90 includes edge portion 94 and only one of walls 34, 36, 38, 40 include a channel 92 and a second section of barrier layer 90 includes a row of teeth that extends along only a portion the perimeter of barrier layer 90. In such embodiments, cover 58 may include an inner row of teeth along the walls 34, 36, 38, 40 that do not include the channel 92. The teeth on cover 58 mate and/or interlock with the teeth along a portion the perimeter of barrier layer 90 such that the inner row of teeth on cover 58 and the teeth on the perimeter of barrier layer 90 form a zipper. The zipper may include a slider to open and close the zipper, as discussed herein. Edge portion 94 is threaded into channel 92 to fix barrier layer 90 to one of walls 34, 36, 38, 40. The slider is then moved along the zipper to close the zipper such that barrier layer 90 is fixed to the other ones of walls 34, 36, 38, 40.

Mattress assembly 30 includes a mattress topper 72 positioned on top of spring pack 66. In embodiments that include barrier layer 90, barrier layer 90 is positioned between spring pack 66 and topper 72. Topper 72 includes a cushion or cushioning material to provide cushioning to the sleeper(s) that lie on top of topper 72. Topper 72 may be removeably coupled to mattress assembly 30. In some embodiments, topper 72 is removeably coupled to spring pack 66. In some embodiments, topper 72 is removeably coupled to cover 58. In some embodiments, cover 58 includes a first part 58*c* of a zipper and topper 72 includes a second part of the zipper to allow topper 72 to be zipped and unzipped from cover 58. For example, first part 58 may include a first row of teeth of the zipper and the second part of the zipper may include a second row of teeth that engage and disengage the first row of teeth as the zipper is zipped and unzipped. Topper 72 can thus be removed for cleaning, etc., and then reattached to cover 58 after topper 72 is cleaned. Removeably coupling topper 72 to cover 58 also allows topper 72 to be replaced if topper 72 wears out and/or if a sleeper desires a topper that is more or less firm. For example, if the user desires a topper that is firmer, topper 72 can be removed by unzipping topper from cover 58. Topper 72 can then be replaced with a topper 72 that is firmer. In some embodiments, topper 72 can be a mat, a mattress topper or a mattress. It is envisioned that topper 72 can have various thicknesses. For example, topper 72 can have a thickness that is less than 1 inch, a thickness that is greater than 3 inches or any thickness between 0.1 inches and 12 inches.

Figure 25:
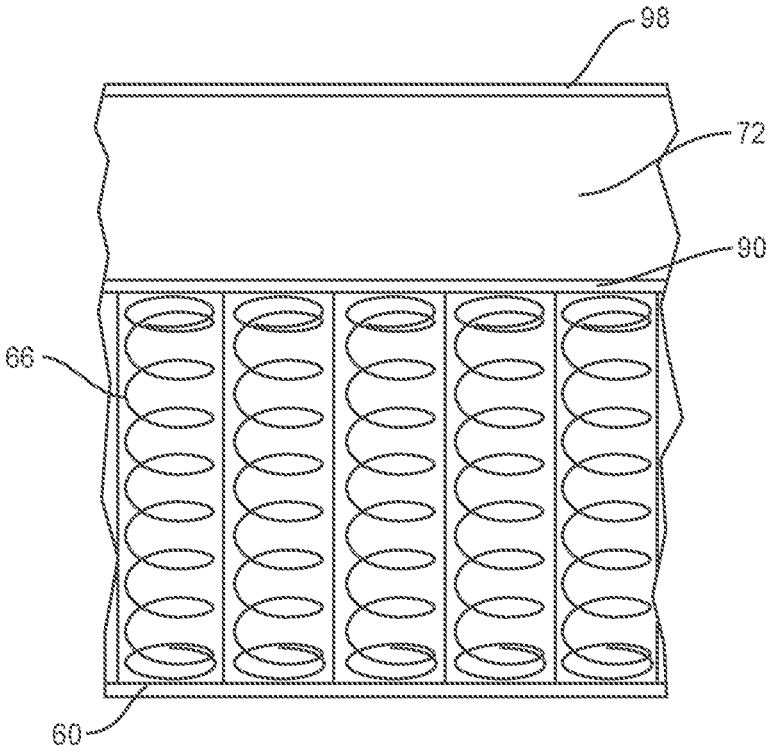
FIG. 25 is a side, cross sectional view of components of the mattress assembly shown in FIG. 1.

In some embodiments, mattress assembly 30 includes an outer layer 98 that covers topper 72 such that topper 72 is positioned between outer layer 98 and barrier layer 90, as shown in FIG. 25. Outer layer 98 is configured to couple topper 72 to chassis 32 such that topper 72 is prevented from shifting relative to chassis 32. In some embodiments, outer layer 98 is coupled to cover 58. In some embodiments, cover 58 includes an outer row of teeth 100 (FIG. 21) that mate and/or interlock with a row of teeth on a perimeter of outer layer 98 such that outer row of teeth 100 and the teeth on the perimeter of outer layer 98 form a zipper. The zipper may include a slider that is movable relative to outer row of teeth 100 and the teeth on the perimeter of outer layer 98 to mesh together or separate outer row of teeth 100 and the teeth on the perimeter of outer layer 98. In some embodiments, outer row of teeth 100 extends circumferentially about cover 58 such that the zipper formed by outer row of teeth 100 and the teeth on the perimeter of outer layer 98 extends circumferentially about chassis 32.

In some embodiments, chassis 32 includes one or more hinges 102 along sidewall 38 and/or sidewall 40, as shown in FIG. 2. Hinges 102 are configured to allow sidewalls 38, 40 to bend along a length thereof. In some embodiments, hinges 102 in sidewall 38 are aligned with hinges 102 in sidewall 40 such that sidewalls 38, 40 can each bend at the same point along their lengths. It is envisioned that hinges 102 may be used to selectively bend sidewalls 38, 40 such that wall 34 is positioned above wall 36 or wall 36 is positioned above wall 34. In some embodiments, hinge 102 is a hinge (e.g., hinge 30) that is described in U.S. Patent Application Ser. No. 62/443,260, filed Jan. 6, 2017, which is incorporated herein by reference, in its entirety. It is envisioned that hinges 102 can be positioned anywhere along sidewall 38 and/or sidewall 40. In some embodiments, hinges 102 can extend the entire length of sidewall 38 and/or sidewall 40. For example, one of hinges 102 can extend along sidewall 38 from wall 34 to wall 36 and/or one of hinges 102 can extend along sidewall 40 from wall 34 to wall 36. In such embodiments, hinges 102 can lock and/or unlock by turning hinge 102 or restricting rotation. In some embodiments, cover 58 covers at least one of hinges 102.

Figure 26:
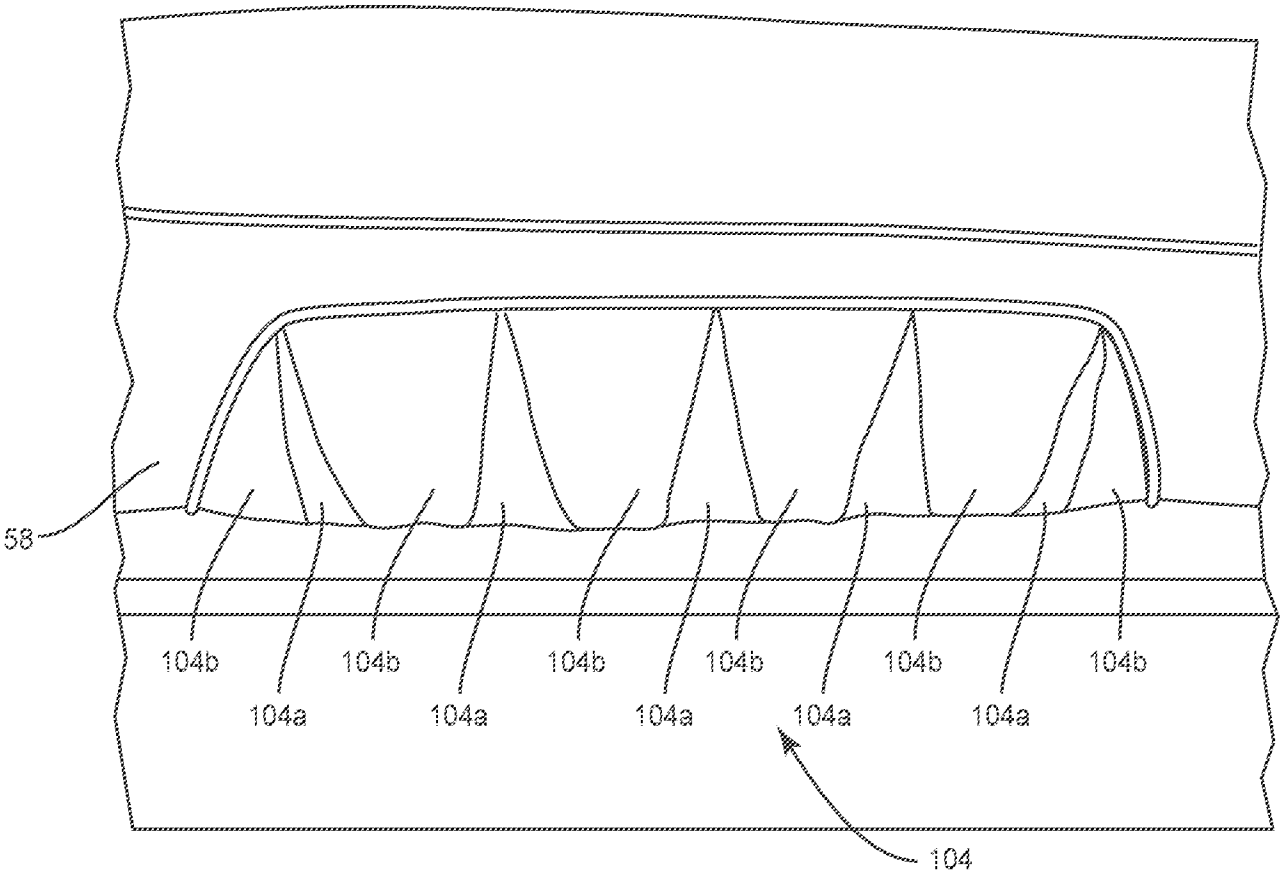
FIG. 26 is a side view of a component of the mattress assembly shown in FIG. 1.

In some embodiments, cover 58 includes one or more joints 104, shown in FIG. 26, for example, that cover hinges 102 to allow cover 58 to bend with hinges 102 without bunching. Joints 104 each include one or a plurality of first sections 104*a* and one or a plurality of second sections 104*b*. Second sections 104*b* are each positioned between adjacent first sections 104*a*. First sections 104*a* are each made from a first material and second sections 104*b* are each made from a second material. The first material is more rigid than the second material such that first sections 104*a* will not bend as hinges 102 bend, but second sections 104*b* will bend as hinges 102 bend. This configuration allows joint 104 to bend in the same manner as hinge 102. That is, joint 104 will bend as hinge 102 bends. In some embodiments, joints 104 have a length that is equal or approximately equal to a length of hinges 102. It is envisioned that joint 104 may include one or a plurality of first sections 104*a* and one or a plurality of second sections 104*b*. In some embodiments, section 104*a* and/or section 104*b* is variously shaped, such as, for example, triangular, square, polygonal, irregular, uniform, non-uniform, offset, staggered, undulating, arcuate, variable and/or tapered.

In operation and use, the components of mattress assembly 30 may be shipped to a destination, such as, for example, a residential home, in one or a plurality of containers, such as, for example, one or a plurality of boxes 62. It is envisioned that the components of mattress assembly 30 may be shipped to the destination via ground shipping. In some embodiments, the components of mattress assembly 30 are shipped to the destination via the U.S. postal system, United Parcel Service or Federal Express. Chassis 32 and cover 58 may be removed from one of the boxes and placed on top of a box spring. Chassis 32 is moved from the compacted configuration discussed herein to the expanded configuration discussed herein. Tambor 64, spring pack 66, topper 72, barrier layer 90 and/or outer layer 98 may be removed from the other box. Tambor 64 is positioned in interior cavity 42 in the manner discussed herein. Spring pack 66 is positioned on top of tambor 64, as discussed herein. Barrier layer 90 is positioned on top of spring pack 66, as discussed herein. Topper 72 is positioned on top of barrier layer 90, as discussed herein. Outer layer 98 is positioned on top of topper 72, as discussed herein.

In some embodiments, a kit is provided that includes one or more of the components of mattress assembly 30 discussed herein. For example, the kit may include one or more chassis, such as, for example, chassis 32 discussed herein. It is envisioned that the chassis of the kit may vary with respect to size, shape and/or material. The kit may include one or more cover, such as, for example, cover 58 discussed herein. It is envisioned that the covers of the kit may vary with respect to size, shape and/or material. For example, the covers may include different fill materials and/or may have different firmnesses. The kit may include one or more tambor, such as, for example, tambor 64 discussed herein. It is envisioned that the tambors of the kit may vary with respect to size, shape and/or material. The kit may include one or more spring pack, such as, for example, spring pack 66 discussed herein. It is envisioned that the spring packs of the kit may vary with respect to size, shape and/or material. For example, the spring packs may include a plurality of spring packs having different firmnesses. The kit may include one or more mattress topper, such as, for example, topper 72 discussed herein. It is envisioned that the spring packs of the kit may vary with respect to size, shape and/or material.

The kit may also include packaging for the contents of the kit. For example, the kit may include a box, such as, for example, a box 62 discussed herein, for packaging chassis 32. The kit may also include a second container, such as, for example, a second box for packaging other contents of the kit. For example, the second box can be used to package the cover, the spring packs and/or the topper. It is envisioned that the second box may be shipped via ground delivery. That is, the second box need not be shipped as freight. The kit may include instructions for assembling a mattress assembly. In some embodiments, the instructions include directions for replacing one or more components of the mattress assembly. In some embodiments, the instructions include directions for cleaning one or more components of the mattress assembly. In some embodiments, the kit includes other bedding items. For example, the kit may include a box spring, bed sheets, pillows, pillow cases, a blanket or comforter, etc.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a chassis comprising a base layer, opposite first and second walls extending upwardly from the base layer and opposite third and fourth walls extending upwardly from the base layer, the first, second, third and fourth walls each being permanently joined with the base layer, the first, second, third and fourth walls and the base layer defining a cavity, the third and fourth walls each being movable relative to the first and second walls;

a cover covering outer surfaces of the first, second, third and fourth walls;

a spring pack positioned in the cavity, the spring pack comprising a plurality of springs;

a barrier layer positioned over the spring pack, the barrier layer being attached to the cover;

a topper positioned over the barrier layer, the topper being attached to the cover; and an outer layer positioned over the topper, the outer layer being attached to the cover.

2. The bedding system recited in claim 1, wherein the base layer extends continuously from the third wall to the fourth wall and continuously from the first wall to the second wall.

3. The bedding system recited in claim 1, wherein the barrier layer is removably attached to the cover, the topper is removably attached to the cover, and the outer layer is removably attached to the cover.

4. The bedding system recited in claim 1, wherein the spring pack comprises first and second spring assemblies each extending continuously from the third wall to the fourth wall.

5. The bedding system recited in claim 4, wherein the first spring assembly is removable from the cavity independent of the second spring assembly.

6. The bedding system recited in claim 4, wherein the spring assemblies are identical.

7. The bedding system recited in claim 4, wherein the first spring assembly is firmer than the second spring assembly.

8. The bedding system recited in claim 4, wherein the spring assemblies each include a plurality of springs, the first spring assembly being different than the second spring assembly.

9. The bedding system recited in claim 8, wherein the springs of the first spring assembly include more coils than the springs of the second spring assembly.

10. The bedding system recited in claim 8, wherein the springs of the first spring assembly have a first gauge and the springs of the second spring assembly have a second gauge that is different than the first gauge.

11. The bedding system recited in claim 4, wherein the spring assemblies each include a plurality of springs positioned within a pocket, the pockets being coupled to one another to form a string of pockets that each include one of springs therein.

12. The bedding system recited in claim 11, wherein the strings of pockets each include a slit between adjacent pockets to allow the springs to move independently of one another.

13. The bedding system recited in claim 12, wherein the slits extend through top surfaces of the strings of pockets between adjacent pockets.

14. The bedding system recited in claim 1, wherein the first, second, third and fourth walls are movable relative to one another to move the system from a compacted configuration to an expanded configuration.

15. A bedding system comprising:

a chassis comprising a base layer, opposite first and second walls extending from the base layer and opposite third and fourth walls each extending from the base layer and from the first wall to the second wall, the first, second, third and fourth walls each being permanently joined with the base layer, the first, second, third and fourth walls defining a cavity, the third and fourth walls each including a first section connected to the first wall and a second section connected to the second wall such that the second section is movable relative to the first section, the first section of the third wall being movable relative to the second section of the third wall, the first section of the fourth wall being movable relative to the second section of the fourth wall;

a cover covering outer surfaces of the first, second, third and fourth walls;

a spring pack positioned in the cavity, the spring pack comprising a proximal wall that directly engages the third wall and an opposite distal wall that directly engages the fourth wall, the spring pack defining a pocket that extends continuously from the proximal wall to the distal wall, the spring pack comprising a plurality of springs disposed in the pocket;

a barrier layer positioned over the spring pack;

a topper positioned over the barrier layer; and an outer layer positioned over the topper.

16. A bedding system comprising:

a chassis comprising a base layer, opposite first and second walls extending upwardly from the base layer and opposite third and fourth walls extending upwardly from the base layer, the first, second, third and fourth walls each being permanently joined with the base layer, the first, second, third and fourth walls defining a cavity, the cavity defining a perimeter, the third and fourth walls each including a first section connected to the first wall and a second section connected to the second wall such that the second section is movable relative to the first section, the first section of the third wall being movable relative to the second section of the third wall, the first section of the fourth wall being movable relative to the second section of the fourth wall;

a cover covering outer surfaces of the first, second, third and fourth walls, the cover comprising a cushioning material within a fabric pocket;

a spring pack positioned in the cavity, the spring pack comprising first and second spring assemblies each extending continuously from a proximal wall that directly engages the third wall to an opposite distal wall that directly engages the fourth wall, the spring assemblies each including a pocket extending continuously from the proximal wall to the distal wall and a plurality of springs disposed in the pocket, the first spring assembly being removable from the cavity independent of the second spring assembly;

a barrier layer positioned over the spring pack, the barrier layer being attached to the cover;

a topper positioned over the barrier layer, the topper being attached to the cover; and an outer layer positioned over the topper, the outer layer being attached directly to the cover such that the outer layer is removable relative to the cover.

* * * * *